US011002489B2

(12) United States Patent
Yamada et al.

(10) Patent No.: US 11,002,489 B2
(45) Date of Patent: May 11, 2021

(54) HEAT EXCHANGER AND AIR CONDITIONING APPARATUS

(71) Applicant: DAIKIN INDUSTRIES, LTD., Osaka (JP)

(72) Inventors: Kouju Yamada, Osaka (JP); Masanori Jindou, Osaka (JP); Ken Satou, Osaka (JP); Hiroaki Matsuda, Osaka (JP); Yoshio Oritani, Osaka (JP); Tomohiko Sakamaki, Osaka (JP); Tomoya Yamaguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/966,533

(22) PCT Filed: Dec. 26, 2018

(86) PCT No.: PCT/JP2018/047902
§ 371 (c)(1),
(2) Date: Jul. 31, 2020

(87) PCT Pub. No.: WO2019/150865
PCT Pub. Date: Aug. 8, 2019

(65) Prior Publication Data

US 2021/0033346 A1 Feb. 4, 2021

(30) Foreign Application Priority Data

Jan. 31, 2018 (JP) ..... JP2018-014964

(51) Int. Cl.
*F28D 7/16* (2006.01)
*F28F 9/02* (2006.01)
(Continued)

(52) U.S. Cl.
CPC ..... *F28D 7/1669* (2013.01); *F28F 9/02* (2013.01); *F28F 9/0221* (2013.01); *F28F 1/02* (2013.01);
(Continued)

(58) Field of Classification Search
CPC ..... F28D 7/1669; F28F 9/02; F28F 9/02202; F28F 9/0224; F28F 9/0221
(Continued)

(56) References Cited

U.S. PATENT DOCUMENTS 5,366,007 A 11/1994 Hutto et al.
5,732,767 A 3/1998 Saperstein
(Continued)

FOREIGN PATENT DOCUMENTS

EP 3220093 A1 9/2017
JP 2007-144470 A 6/2007
(Continued)

OTHER PUBLICATIONS

Notification of Transmittal of Translation of the International Preliminary Report on Patentability for International Application No. PCT/JP2018/047902, dated Aug. 13, 2020 (1 page).
(Continued)

*Primary Examiner* — Joel M Attey
(74) *Attorney, Agent, or Firm* — Osha Bergman Watanabe & Burton LLP

(57) ABSTRACT

A heat exchanger includes: heat transfer tubes that are made of aluminum or an aluminum alloy and are disposed in multiple tiers in a first direction that intersects a second direction along which a heating medium flows; and a coupling header that couples the heat transfer tubes together. The coupling header includes: a first member that includes a first core made of aluminum or an aluminum alloy and a first sacrificial anode layer; a second member that includes
(Continued)

no sacrificial anode layer; and a third member that includes a second core made of aluminum or an aluminum alloy and a second sacrificial anode layer.

8 Claims, 17 Drawing Sheets

(51) Int. Cl.
*F28F 21/08* (2006.01)
*F28F 1/02* (2006.01)
*F28F 1/12* (2006.01)

(52) U.S. Cl.
CPC ..... *F28F 1/12* (2013.01); *F28F 9/0202* (2013.01); *F28F 9/0224* (2013.01); *F28F 21/084* (2013.01); *F28F 2215/12* (2013.01); *F28F 2275/04* (2013.01)

(58) Field of Classification Search
USPC ..... 165/173, 175
See application file for complete search history.

(56) References Cited

U.S. PATENT DOCUMENTS

| | | | | |
|---|---|---|---|---|
| 9,995,534 | B2 * | 6/2018 | Katoh | F28D 1/0246 |
| 2001/0054496 | A1 | 12/2001 | Kajikawa et al. | |
| 2007/0131392 | A1 * | 6/2007 | Minami | F28D 1/0391 165/110 |
| 2017/0045316 | A1 * | 2/2017 | Terayama | F28F 19/06 |
| 2017/0292741 | A1 | 10/2017 | Inoue et al. | |
| 2017/0314792 | A1 | 11/2017 | Jindou et al. | |

FOREIGN PATENT DOCUMENTS

| | | | |
|---|---|---|---|
| JP | 2009-275246 | A | 11/2009 |
| JP | 2013-189659 | A | 9/2013 |
| JP | 2015-113983 | A | 6/2015 |
| JP | 2016-095087 | A | 5/2016 |
| JP | 2016-200312 | A | 12/2016 |
| KR | 10-2017-0116726 | A | 10/2017 |
| WO | 2005/114085 | A1 | 12/2005 |
| WO | 2015/162911 | A1 | 10/2015 |
| WO | 2016-052299 | A1 | 4/2016 |
| WO | 2016/076259 | A1 | 5/2016 |
| WO | 2016/076260 | A1 | 5/2016 |

OTHER PUBLICATIONS

International Preliminary Report on Patentability issued in PCT/JP2018/047902, dated Aug. 4, 2020 (7 pages).
International Search Report issued in corresponding International Application No. PCT/JP2018/047902 dated Apr. 2, 2019 (5 pages).
Written Opinion of the International Searching Authority issued in corresponding International Application No. PCT/JP2018/047902 dated Apr. 2, 2019 (5 pages).
Notice of Reasons for Refusal issued in corresponding Japanese Patent Application No. 2018-014964 dated Mar. 26,2019 (6 pages).
Extended European Search Report issued in corresponding European Patent Patent Application No. 18903462.2 dated Feb. 3, 2021 (8 pages).

* cited by examiner

HEAT EXCHANGER AND AIR CONDITIONING APPARATUS

TECHNICAL FIELD

A heat exchanger made of aluminum or an aluminum alloy, and an air conditioning apparatus including the heat exchanger.

BACKGROUND

As one of known heat exchangers, for example, Patent Literature 1 (JP 2016-95087 A) discloses a heat exchanger made of aluminum.

As disclosed in Patent Literature 1, according to the heat exchanger made of aluminum, the corrosion resistance of a component made of aluminum exerts an influence upon a service life of the heat exchanger. For example, when a coupling header is made of aluminum or an aluminum alloy, the corrosion of aluminum or an aluminum alloy sometimes causes damage to the heat exchanger.

SUMMARY

One or more embodiments of the present invention inexpensively improve the corrosion resistance of a heat exchanger made of aluminum or an aluminum alloy.

According to one or more embodiments, a heat exchanger including: a plurality of heat transfer tubes each made of aluminum or an aluminum alloy, the heat transfer tubes being arranged in multiple tiers in a direction intersecting a direction along which a heating medium flows; and a coupling header coupling the heat transfer tubes together, wherein the coupling header includes: a first member having a first inner surface where the heating medium flows and first ends of the heat transfer tubes are disposed, and a first outer surface on an opposite side of the first inner surface, the first member including a first core made of aluminum or an aluminum alloy, and a first sacrificial anode layer disposed for the first core on the first outer surface; a second member made of aluminum or an aluminum alloy, the second member having a second inner surface where the heating medium flows, and a second outer surface on an opposite side of the second inner surface, the second member including no sacrificial anode layer; and a third member having a joining surface facing at least one of the second outer surface or the first outer surface, and an exposed surface on an opposite side of the joining surface, the third member including a second core made of aluminum or an aluminum alloy, and a second sacrificial anode layer disposed for the second core on the exposed surface, the third member covering a partial region or an entire region of the second outer surface with the joining surface joined to the partial region or the entire region.

In the heat exchanger having the configuration described above, the third member improves the corrosion resistance of the second member that is processed with ease since the second member includes no sacrificial anode layer. This configuration therefore inexpensively improves the corrosion resistance of the entire heat exchanger.

In the heat exchanger according to one or more embodiments, the third member includes a brazed joint in the partial region or the entire region. In the heat exchanger having the configuration described above, the brazed joint in the partial region or entire region connecting a surface of the second member to a surface of the third member ensures favorable joining of the entire surface of the brazed joint. This configuration therefore suppresses an increase in corrosion protection area caused by an increase in surface areas of the second member and third member due to a gap between unjoined portions. This configuration thus efficiently achieves the effect of corrosion protection by the second sacrificial anode layer.

In the heat exchanger according to one or more embodiments, the brazed joint includes a brazing material for brazing in a furnace. In the heat exchanger having the configuration described above, the brazed joint includes a brazing material for brazing in a furnace. This configuration suppresses flux, and also suppresses a reduction in corrosion resistance around a brazed portion.

In the heat exchanger according to one or more embodiments, wherein the second member is an extruded molding. In the heat exchanger having the configuration described above, the second member is an extruded molding. This configuration therefore inexpensively achieves a complicated shape of the second member surrounding a communication space.

In the heat exchanger according to one or more embodiments, the second member includes a plurality of split bodies arranged in a direction along which the heat transfer tubes are arranged in the multiple tiers. In the heat exchanger having the configuration described above, the second member is split into a plurality of split bodies. As compared with a second member that is formed integrally without being split, the second member having the second inner surface for surrounding a communication space is formed with ease, which leads to a reduction in cost of the heat exchanger.

In the heat exchanger according to one or more embodiments, the third member is a plate-shaped member having an end bent along the second member. In the heat exchanger having the configuration described above, the third member is a plate-shaped member on which the second sacrificial anode layer is formed with ease. This configuration therefore inexpensively achieves the third member including the second sacrificial anode layer, which leads to a reduction in cost of the heat exchanger.

In the heat exchanger according to one or more embodiments, the first sacrificial anode layer is a brazing material joining the heat transfer tubes to the first member. In the heat exchanger having the configuration described above, the first sacrificial anode layer serves as a brazing material. This configuration therefore facilitates joining of the heat transfer tubes to the first member, which leads to a reduction in cost of the heat exchanger.

According to one or more embodiments, an air conditioning apparatus including: the heat exchanger according to the embodiments described above, the air conditioning apparatus being configured to perform air conditioning in a predetermined space by heat exchange between the heating medium circulating through the air conditioning apparatus via the heat exchanger and air in the predetermined space.

In the air conditioning apparatus having the configuration described above, the corrosion resistance of the entire heat exchanger is inexpensively improved. This configuration thus inexpensively improves the corrosion resistance of the air conditioning apparatus.

DETAILED DESCRIPTION

(1) General Configuration

Figure 1:
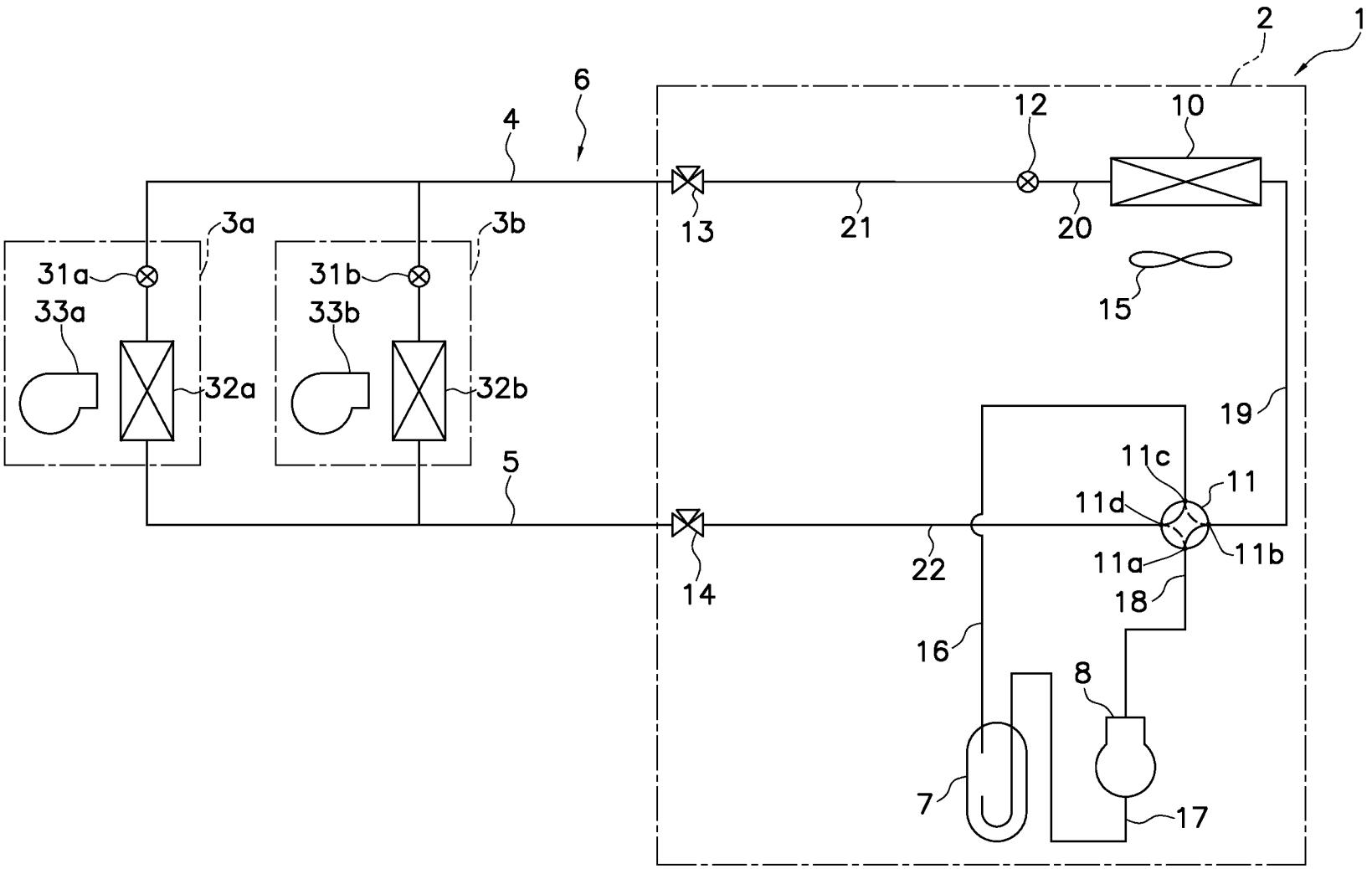
FIG. 1 illustrates an exemplary refrigerant circuit in an air conditioning apparatus according to one or more embodiments.

FIG. 1 illustrates an exemplary air conditioning apparatus to which a heat exchanger according to one or more embodiments of the present invention is applied. A heating medium flows through the heat exchanger. The heating medium is heated or cooled by heat exchange. The heating medium is a fluid for use in heat transfer between the heat exchanger and a device outside the heat exchanger. Examples of the heating medium may include, but not limited to, chlorofluorocarbon refrigerant such as hydrofluorocarbon (HFC) refrigerant, carbon dioxide, water, and brine. A heating medium includes a refrigerant. In the following, a description will be given of a case where a heating medium is a refrigerant. As illustrated in FIG. 1, an air conditioning apparatus 1 includes a heat source unit 2, two utilization units 3*a* and 3*b*, and a liquid-refrigerant connection pipe 4 and a gas-refrigerant connection pipe 5 each connecting the heat source unit 2 to the utilization units 3*a* and 3*b*. The air conditioning apparatus 1 has a function of cooling and heating the interiors of rooms in, for example, a building where the utilization units 3*a* and 3*b* are installed. In the air conditioning apparatus 1, the heat source unit 2 and the utilization units 3*a* and 3*b* are connected via the liquid-refrigerant connection pipe 4 and the gas-refrigerant connection pipe 5 to constitute a refrigerant circuit 6. The refrigerant circulates through the refrigerant circuit 6. During the circulation, the refrigerant is repeatedly subjected to a refrigeration cycle in which the refrigerant is compressed so that the temperature thereof increases, radiates heat, is decompressed and expanded, absorbs heat, and returns to a state before being compressed. When the refrigerant is repeatedly subjected to the refrigeration cycle, the refrigerant alternately turns into a low pressure state and a high pressure state.

The heat source unit 2 is installed outdoors. For example, the heat source unit 2 is installed on the rooftop of a building or near a wall surface of a building. The heat source unit 2 includes an accumulator 7, a compressor 8, a four-way switching valve 11, a heat source-side heat exchanger 10, a heat source-side expansion valve 12, a liquid-side shutoff valve 13, a gas-side shutoff valve 14, and a heat source-side fan 15. In the heat source unit 2, a refrigerant pipe 16 connects a third port 11*c* of the four-way switching valve 11 to an inlet pipe of the accumulator 7. A refrigerant pipe 17 connects an outlet pipe of the accumulator 7 to a suction port of the compressor 8. A refrigerant pipe 18 connects a discharge port of the compressor 8 to a first port 11*a* of the four-way switching valve 11. A refrigerant pipe 19 connects a second port 11*b* of the four-way switching valve 11 to a gas-side port of the heat source-side heat exchanger 10. A refrigerant pipe 20 connects a liquid-side port of the heat source-side heat exchanger 10 to a first port of the heat source-side expansion valve 12. A refrigerant pipe 21 connects a second port of the heat source-side expansion valve 12 to the liquid-side shutoff valve 13. A refrigerant pipe 22 connects the gas-side shutoff valve 14 to a fourth port 11*d* of the four-way switching valve 11.

The utilization units 3*a* and 3*b* are each installed indoors. For example, the utilization units 3*a* and 3*b* are each installed on a residential room or in a roof-space. The utilization unit 3*a* includes a utilization-side expansion valve 31*a*, a utilization-side heat exchanger 32*a*, and a utilization-side fan 33*a*. The utilization unit 3*b* includes a utilization-side expansion valve 31*b*, a utilization-side heat exchanger 32*b*, and a utilization-side fan 33*b*. The liquid-refrigerant connection pipe 4 is connected to a first port of the utilization-side expansion valve 31*a* and a first port of the utilization-side expansion valve 31*b*. A second port of the utilization-side expansion valve 31*a* is connected to a first port of the utilization-side heat exchanger 32*a*. A second port of the utilization-side expansion valve 31*b* is connected to a first port of the utilization-side heat exchanger 32*b*. The gas-refrigerant connection pipe 5 is connected to a second port of the utilization-side heat exchanger 32*a* and a second port of the utilization-side heat exchanger 32*b*.

(2) Operations of Air Conditioning Apparatus 1

(2-1) Cooling Operation

During a cooling operation, the air conditioning apparatus 1 forms at least one of a circulation route by which the refrigerant from the compressor 8 flows through the heat source-side heat exchanger 10, the heat source-side expansion valve 12, the utilization-side expansion valve 31*a*, and the utilization-side heat exchanger 32*a*, and then returns to the compressor 8 again or a circulation route by which the refrigerant from the compressor 8 flows through the heat source-side heat exchanger 10, the heat source-side expansion valve 12, the utilization-side expansion valve 31*b*, and the utilization-side heat exchanger 32*b*, and then returns to the compressor 8 again. For example, one of the utilization-side expansion valves 31*a* and 31*b* may be closed for closing one of the circulation routes. In order to form the circulation routes, during the cooling operation, the four-way switching valve 11 is switched to form a passage from the first port 11*a* to the second port 11*b* and a passage from the third port 11*c* to the fourth port 11*d*, as indicated by solid lines in FIG. 1. The refrigerant described by way of example herein changes into a gas refrigerant being a refrigerant in a substantially gas state, a liquid refrigerant being a refrigerant in a substantially liquid state, and a refrigerant in a gas-liquid two-phase state in which the gas refrigerant and the liquid refrigerant are mixed together, in a vapor compression refrigeration cycle.

During the cooling operation, in the refrigerant circuit 6, the low-pressure gas refrigerant is sucked into the compressor 8 through the suction port of the compressor 8, and then is compressed by the compressor 8, so that the high-pressure gas refrigerant is discharged from the compressor 8 through the discharge port of the compressor 8. The high-pressure gas refrigerant is fed from the compressor 8 to the heat source-side heat exchanger 10 via the refrigerant pipe 18, the four-way switching valve 11, and the refrigerant pipe 19. The heat source-side heat exchanger 10 serving as a refrigerant radiator causes the high-temperature and high-pressure gas refrigerant to exchange heat with air supplied to the heat source-side heat exchanger 10 through the heat source-side fan 15. The high-temperature and high-pressure gas refrigerant thus radiates heat to turn into the high-pressure liquid refrigerant. The high-pressure liquid refrigerant is fed from the heat source-side heat exchanger 10 to the utilization-side expansion valves 31*a* and 31*b* via the refrigerant pipe 20, the heat source-side expansion valve 12, the refrigerant pipe 21, the liquid-side shutoff valve 13, and the liquid-refrigerant connection pipe 4. At this time, for example, the heat source-side expansion valve 12 of the heat source unit 2 is fully opened, so that the refrigerant passes through the heat source-side expansion valve 12 without being decompressed. The refrigerant fed to the utilization-side expansion valves 31*a* and 31*b* is decompressed by the utilization-side expansion valves 31*a* and 31*b*. The refrigerant thus turns into the refrigerant in a low-pressure gas-liquid two-phase state. The refrigerant in the low-pressure gas-liquid two-phase state is fed from the utilization-side expansion valves 31*a* and 31*b* to the utilization-side heat exchangers 32*a* and 32*b*. The utilization-side heat exchangers 32*a* and 32*b* each serving as an evaporator cause the refrigerant in the low-pressure gas-liquid two-phase state to exchange heat with indoor air supplied to the utilization-side heat exchangers 32*a* and 32*b* through the utilization-side fans 33*a* and 33*b*. The refrigerant thus absorbs heat to turn into the low-pressure gas refrigerant. The indoor air cooled in the utilization-side heat exchangers 32*a* and 32*b* is supplied indoors to cool the interiors of a building. The low-pressure gas refrigerant from the utilization-side heat exchangers 32*a* and 32*b* is sucked into the compressor 8 again via the gas-refrigerant connection pipe 5, the gas-side shutoff valve 14, the refrigerant pipe 22, the four-way switching valve 11, the refrigerant pipe 16, the accumulator 7, and the refrigerant pipe 17.

(2-2) Heating Operation

During a heating operation, the air conditioning apparatus 1 forms at least one of a circulation route by which the refrigerant from the compressor 8 flows through the utilization-side heat exchanger 32*a*, the utilization-side expansion valve 31*a*, the heat source-side expansion valve 12, and the heat source-side heat exchanger 10, and then returns to the compressor 8 again or a circulation route by which the refrigerant from the compressor 8 flows through the utilization-side heat exchanger 32*b*, the utilization-side expansion valve 31*b*, the heat source-side expansion valve 12, and the heat source-side heat exchanger 10, and then returns to the compressor 8 again. For example, one of the utilization-side expansion valves 31*a* and 31*b* may be closed for closing one of the circulation routes. In order to form the circulation routes, during the heating operation, the four-way switching valve 11 is switched to form a passage from the first port 11*a* to the fourth port 11*d* and a passage from the second port 11*b* to the third port 11*c*, as indicated by broken lines in FIG. 1.

During the heating operation, in the refrigerant circuit 6, the low-pressure gas refrigerant is sucked into the compressor 8 through the suction port of the compressor 8, and then is compressed by the compressor 8, so that the high-pressure gas refrigerant is discharged from the compressor 8 through the discharge port of the compressor 8. The high-pressure gas refrigerant is fed from the compressor 8 to the utilization-side heat exchangers 32*a* and 32*b* via the refrigerant pipe 18, the four-way switching valve 11, the refrigerant pipe 22, the gas-side shutoff valve 14, and the gas-refrigerant connection pipe 5. The utilization-side heat exchangers 32*a* and 32*b* each serving as a refrigerant radiator cause the high-temperature and high-pressure gas refrigerant to exchange heat with indoor air supplied to the utilization-side heat exchangers 32*a* and 32*b* through the utilization-side fans 33*a* and 33*b*. The high-temperature and high-pressure gas refrigerant thus radiates heat to turn into the high-pressure liquid refrigerant. The indoor air heated in the utilization-side heat exchangers 32*a* and 32*b* is supplied indoors to heat the interiors of the building. The high-pressure liquid refrigerant is fed from the utilization-side heat exchangers 32*a* and 32*b* to the heat source-side expansion valve 12 via the utilization-side expansion valves 31*a* and 31*b*, the liquid-refrigerant connection pipe 4, the liquid-side shutoff valve 13, and the refrigerant pipe 21. At this time, for example, the utilization-side expansion valves 31*a* and 31*b* of the utilization units 3*a* and 3*b* are each fully opened, so that the refrigerant passes through the utilization-side expansion valves 31*a* and 31*b* without being decompressed. The refrigerant fed to the heat source-side expansion valve 12 of the heat source unit 2 is decompressed by the heat source-side expansion valve 12. The refrigerant thus turns into the refrigerant in the low-pressure gas-liquid two-phase state. The refrigerant in the low-pressure gas-liquid two-phase state is fed from the heat source-side expansion valve 12 to the heat source-side heat exchanger 10. The heat source-side heat exchanger 10 serving as an evaporator causes the refrigerant in the low-pressure gas-liquid two-phase state to exchange heat with air supplied to the heat source-side heat exchanger 10 through the heat source-side fan 15. The refrigerant thus absorbs heat to turn into the low-pressure gas refrigerant. The low-pressure gas refrigerant from the heat source-side heat exchanger 10 is sucked into the compressor 8 again via the refrigerant pipe 19, the four-way switching valve 11, the refrigerant pipe 16, the accumulator 7, and the refrigerant pipe 17.

(3) Configuration of Heat Source Unit 2

Figure 2:
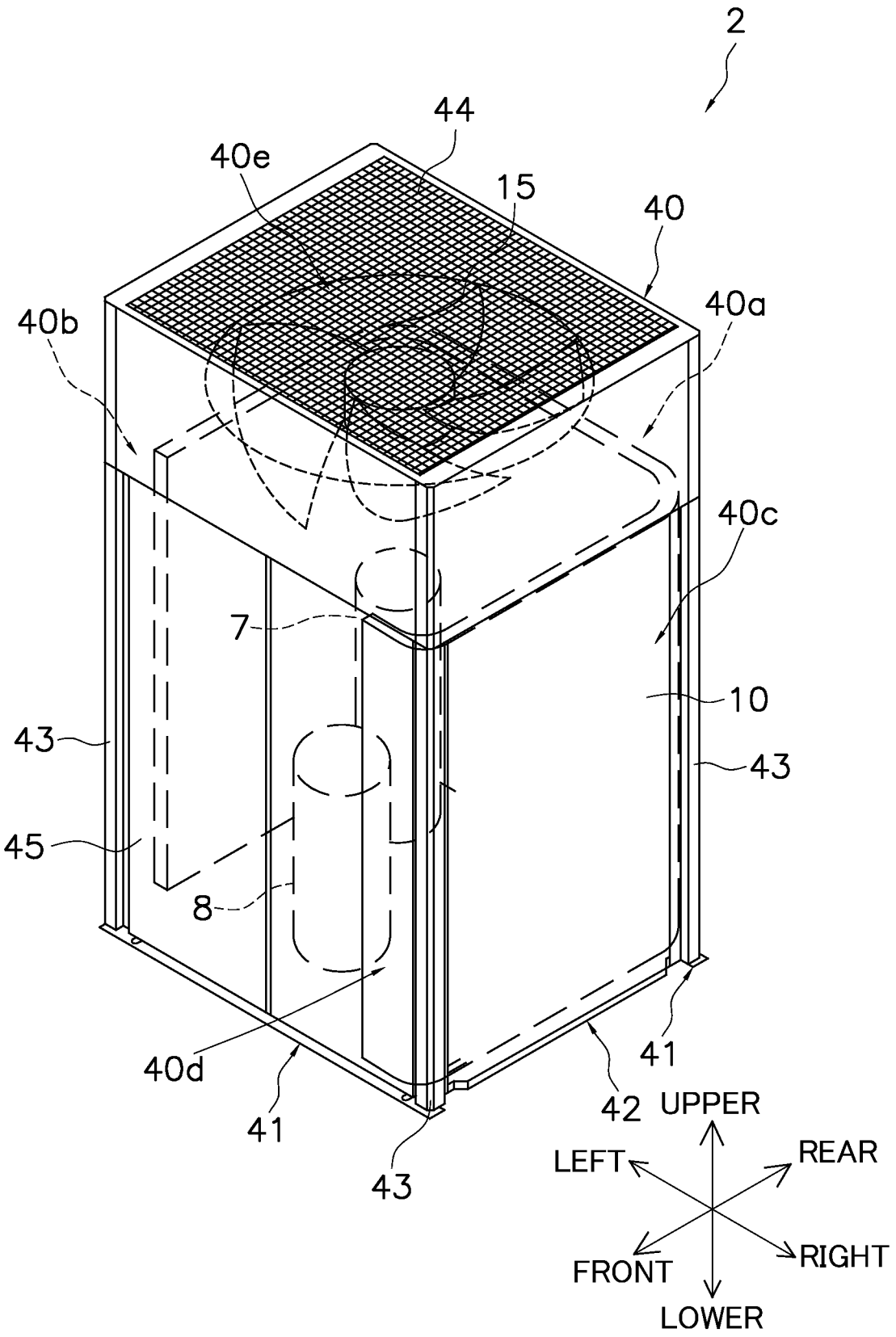
FIG. 2 is a perspective view of a heat source unit.

FIG. 2 illustrates the heat source unit 2 seen obliquely from above. The heat source unit 2 further includes a casing 40 accommodating therein the accumulator 7, the compressor 8, the four-way switching valve 11, the heat source-side heat exchanger 10, the heat source-side expansion valve 12, and the heat source-side fan 15. In the following description, the "upper side", lower side", "left side", "right side", "front side, and "rear side" of the heat source unit 2 respectively denote directions indicated by coordinates in FIG. 2 unless otherwise specified. The heat source unit 2 is a heat exchange unit configured to suck thereinto air through side surfaces of the casing 40 and to blow out air subjected to heat exchange in the casing 40, upward through a top surface of the casing 40.

The casing 40 includes: a pair of installation legs 41 extending laterally; a bottom frame 42 disposed on the installation legs 41; supports 43 extending vertically from corners of the bottom frame 42; a blow-out grille 44 located near upper ends of the supports 43; and a front surface panel 45. In the casing 40, the side surfaces respectively have air suction ports 40*a*, 40*b*, 40*c*, and 40*d*, and the top surface has an air blow-out port 40*e*. The air blow-out port 40*e* is covered with the blow-out grille 44, and the heat source-side fan 15 is located to face the blow-out grille 44.

Figure 3:
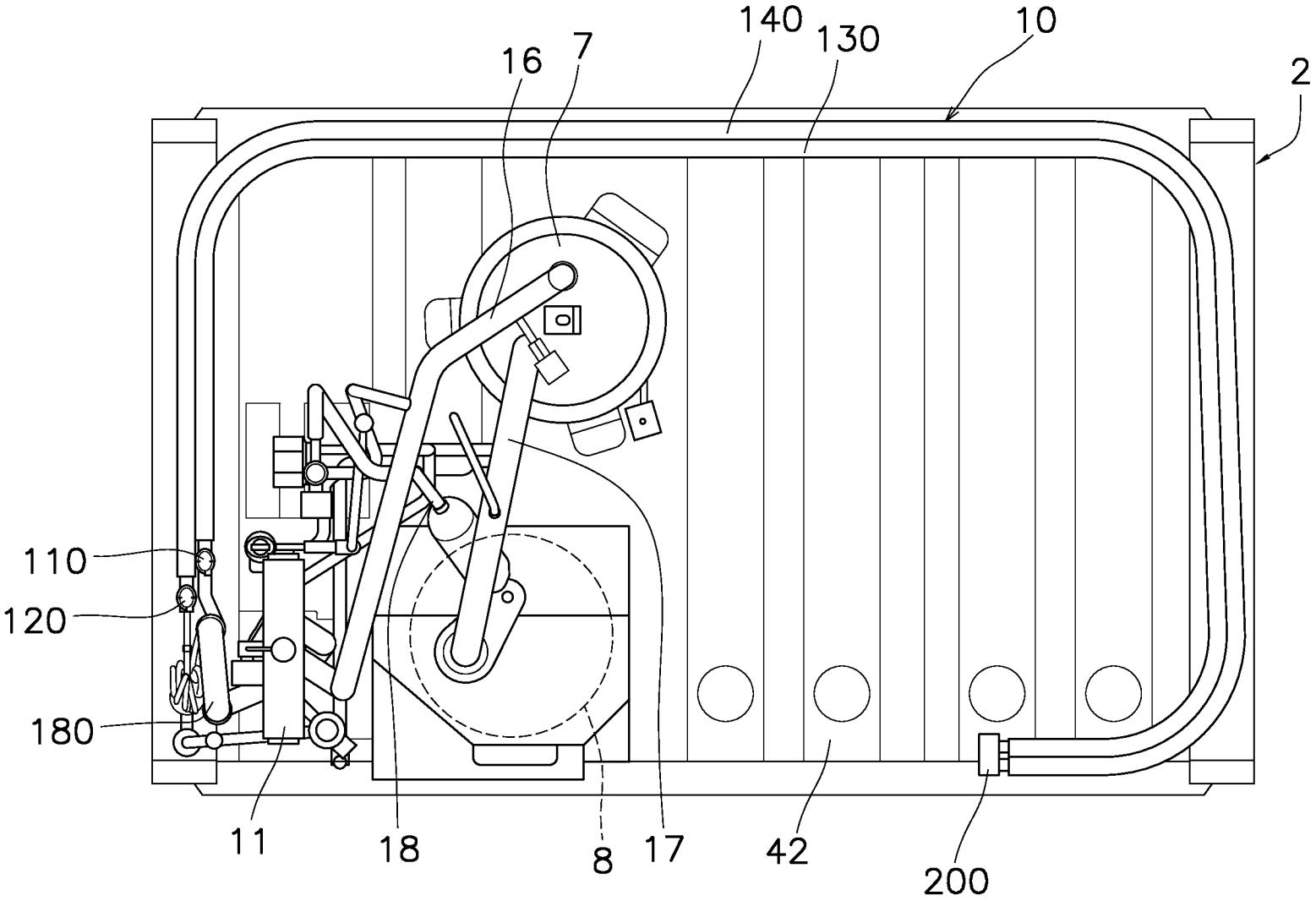
FIG. 3 is a plan view of a heat source-side heat exchanger, a compressor, and the like on a bottom frame of the heat source unit.

The bottom frame 42 corresponds to a bottom surface of the casing 40. The heat source-side heat exchanger 10, the accumulator 7, and the compressor 8 are mounted on the bottom frame 42. FIG. 3 illustrates the heat source-side heat exchanger 10, the four-way switching valve 11, the refrigerant pipe 16, the accumulator 7, the refrigerant pipe 17, the compressor 8, the refrigerant pipe 18, and the like disposed in a space defined under the heat source-side fan 15. The heat source-side heat exchanger 10 is disposed to extend along the four side surfaces of the casing 40 except a part of the entire periphery surrounding the four side surfaces. That is, the heat source-side heat exchanger 10 has a "C" shape as seen from above. The heat source-side fan 15 supplies air to the casing 40. The air is sucked into the casing 40 through the air suction ports 40*a* to 40*d* in the side surfaces so as to flow toward the air blow-out port 40*e* in the top surface. At this time, the air flows through the heat source-side heat exchanger 10. The bottom frame 42 is in contact with a lower end of the heat source-side heat exchanger 10, and serves as a drain pan configured to retain water to be generated in the heat source-side heat exchanger 10 during the cooling operation.

(4) Configuration of Heat Source-Side Heat Exchanger 10

Figure 4:
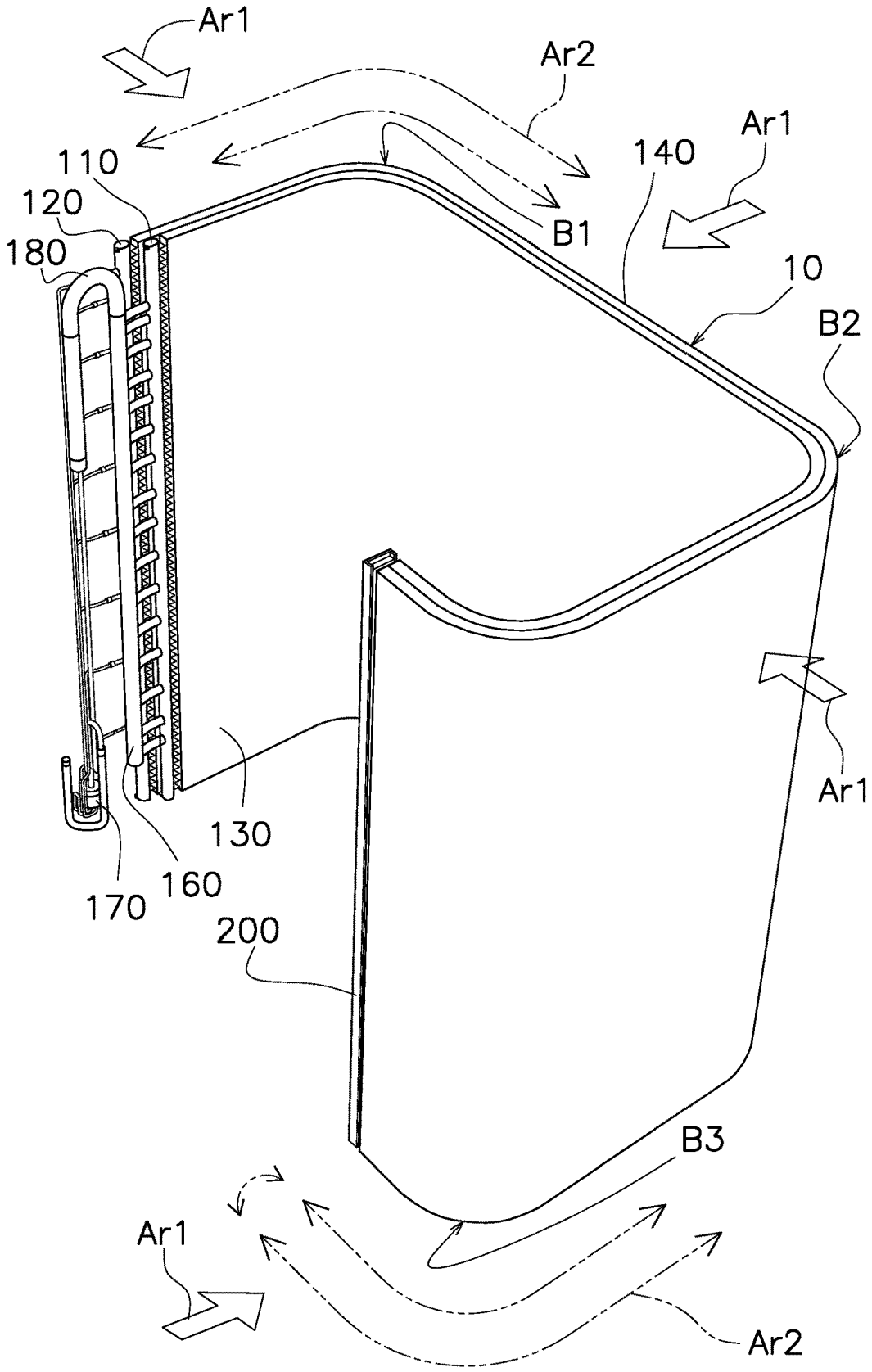
FIG. 4 is a perspective view of the heat source-side heat exchanger.

FIG. 4 illustrates the heat source-side heat exchanger 10 seen obliquely from above. The heat source-side heat exchanger 10 includes a first header collecting pipe 110, a second header collecting pipe 120, a heat exchange part 130 in a leeward row, a heat exchange part 140 in a windward row, a coupling header 200, a gas collecting pipe 160, and a refrigerant shunt 170. In the heat source-side heat exchanger 10, each of the first header collecting pipe 110, the second header collecting pipe 120, the heat exchange parts 130 and 140, the coupling header 200, the gas collecting pipe 160, and the refrigerant shunt 170 is made of an aluminum alloy. In assembling the first header collecting pipe 110, the second header collecting pipe 120, the heat exchange parts 130 and 140, the coupling header 200, the gas collecting pipe 160, and the refrigerant shunt 170 into the heat source-side heat exchanger 10, these components are joined together by brazing in a furnace with a brazing material containing an aluminum alloy.

In FIG. 4, wide arrows Ar1 indicate flows of air directed from the outside to the inside of the heat source-side heat exchanger 10. Also in FIG. 4, arrows Ar2 shown by chain double-dashed lines indicate flows of the refrigerant. The arrows Ar2 are double-headed arrows since the refrigerant flows in opposite directions during the heating operation and the cooling operation. During the cooling operation, the refrigerant from the first header collecting pipe 110 flows through the heat exchange part 130 in the leeward row, and then turns back at the coupling header 200. Thereafter, the refrigerant from the coupling header 200 flows through the heat exchange part 140 in the windward row, and then reaches the second header collecting pipe 120. During the heating operation, the refrigerant from the second header collecting pipe 120 flows through the heat exchange part 140 in the windward row, and then turns back at the coupling header 200. Thereafter, the refrigerant from the coupling header 200 flows through the heat exchange part 130 in the leeward row, and then reaches the first header collecting pipe 110.

(4-1) Heat Exchange Parts 130, 140

Figure 5:
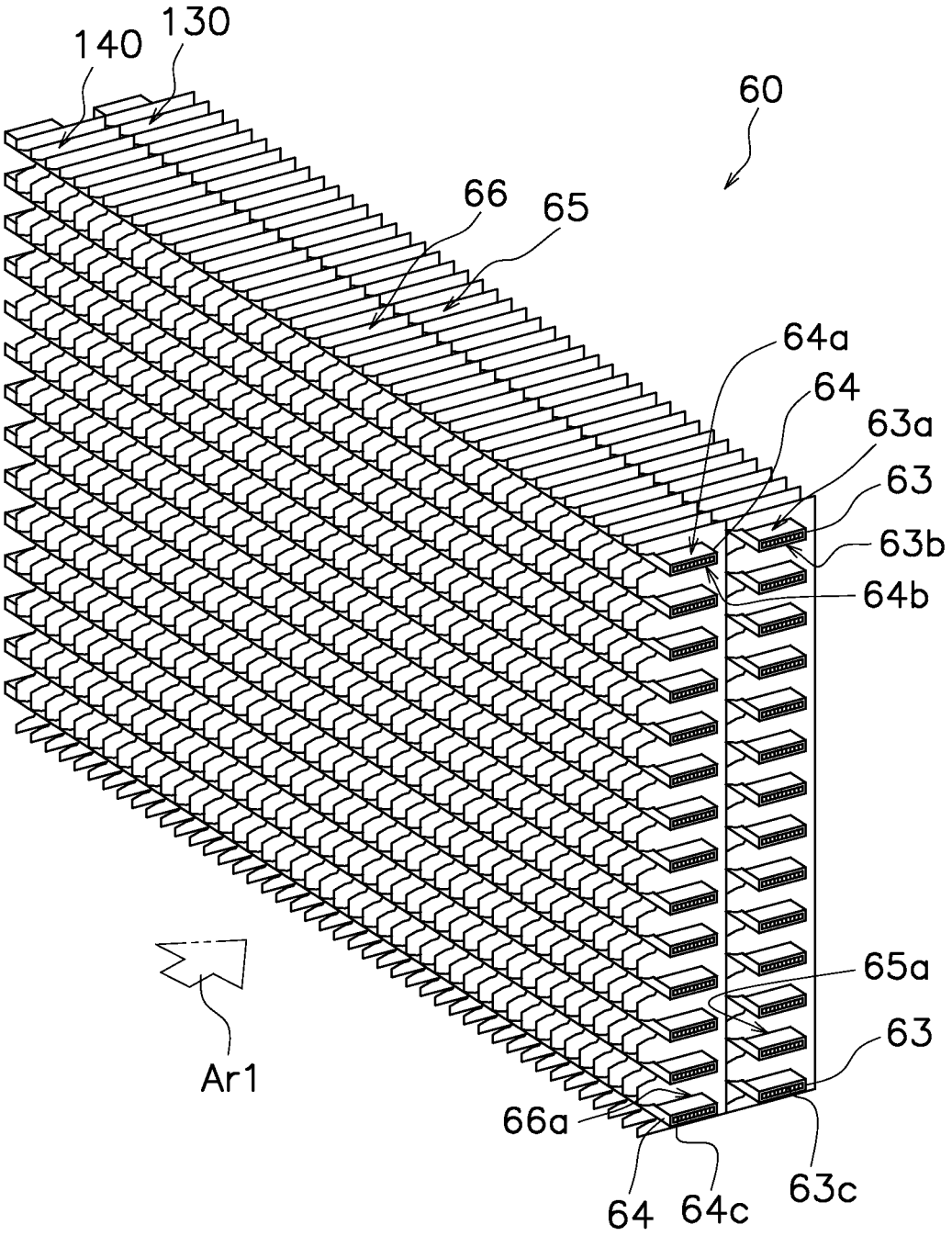
FIG. 5 is a perspective view of a heat exchange part.

As illustrated in FIG. 5, the heat exchange part 130 in the leeward row includes a plurality of flat pipes 63 in the leeward row and a plurality of heat transfer fins 65 in the leeward row. Also in FIG. 5, an arrow Ar1 indicates a flow of air. As illustrated in FIG. 5, the heat exchange part 140 in the windward row includes a plurality of flat pipes 64 in the windward row and a plurality of heat transfer fins 66 in the windward row.

Each flat pipe 63 as a flat porous pipe includes an upper surface portion 63*a* oriented vertically, a lower surface portion 63*b* oriented vertically, and a plurality of small passages 63*c* which are formed in the flat pipe 63 and through which the refrigerant flows. Each flat pipe 64 as a flat porous pipe includes an upper surface portion 64*a* oriented vertically, a lower surface portion 64*b* oriented vertically, and a plurality of small passages 64*c* which are formed in the flat pipe 64 and through which the refrigerant flows. The flat pipes 63 are vertically arranged in multiple tiers in the leeward row. The flat pipes 64 are vertically arranged in multiple tiers in the windward row. Each flat pipe 63 in the leeward row has a first end connected to the first header collecting pipe 110 and a second end connected to the coupling header 200. Each flat pipe 64 in the windward row has a first end connected to the second header collecting pipe 120 and a second end connected to the coupling header 200. Each heat transfer fin 65 extends vertically and along a flow of air that flows between adjacent two of the flat pipes 63 so as to enlarge a heat transfer area in heat exchange of the refrigerant. Each heat transfer fin 66 extends vertically and along a flow of air that flows between adjacent two of the flat pipes 64 so as to enlarge a heat transfer area in heat exchange of the refrigerant. Each heat transfer fin 65 has a plurality of cutouts 65*a* formed in correspondence with the flat pipes 63 in the respective tiers. Each heat transfer fin 66 has a plurality of cutouts 66*a* formed in correspondence with the flat pipes 64 in the respective tiers. The cutouts 65*a* and 66*a* are each elongated in a direction perpendicular to the vertical direction. Each cutout 65*a* has a circumference joined to the corresponding upper and lower surface portions 63*a* and 63*b* each serving as a heat transfer surface in close contact with the upper and lower surface portions 63*a* and 63*b*. Each cutout 66*a* has a circumference joined to the corresponding upper and lower surface portions 64*a* and 64*b* each serving as a heat transfer surface in close contact with the upper and lower surface portions 64*a* and 64*b*.

(4-2) First Header Collecting Pipe 110, Gas Collecting Pipe 160

Figure 6:
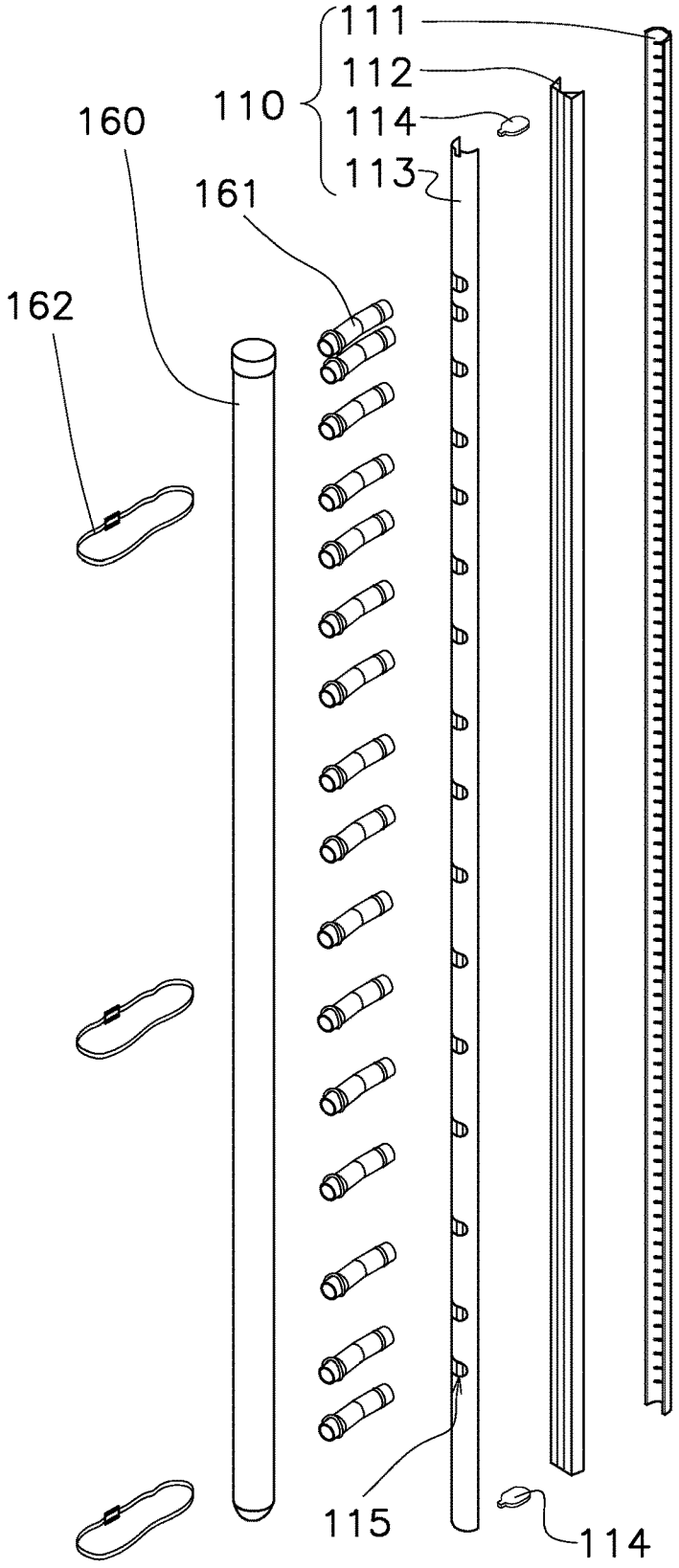
FIG. 6 is an exploded perspective view of a first header collecting pipe and a gas collecting pipe.

FIG. 6 is an exploded view of the first header collecting pipe 110 and the gas collecting pipe 160. The first header collecting pipe 110 is an elongated hollow tubular component whose upper and lower ends are closed. The first header collecting pipe 110 is disposed upright on the first end side of the heat exchange part 130 in the leeward row. The first header collecting pipe 110 includes a porous pipe-side member 111, a partitioning member 112, a pipe-side member 113, and partition plates 114. The elongated porous pipe-side member 111, partitioning member 112, and pipe-side member 113 are combined with their longitudinal directions oriented vertically, and are integrated with the partitioning member 112 interposed between the porous pipe-side member 111 and the pipe-side member 113. The porous pipe-side member 111, the partitioning member 112, and the pipe-side member 113 thus constitute the first header collecting pipe 110 extending vertically in the heat source-side heat exchanger 10. The two partition plates 114 respectively close the top and bottom of the first header collecting pipe 110. The porous pipe-side member 111, the partitioning member 112, the pipe-side member 113, and the partition plates 114 are integrated with one another by, for example, joining in a furnace with a brazing material.

The porous pipe-side member 111 has an arc shape cross-section cut along a plane perpendicular to the vertical direction. The porous pipe-side member 111 has a plurality of openings into which the flat pipes 63 arranged in the multiple tiers are respectively inserted. The number of openings is equal to the number of flat pipes 63. The partitioning member 112 has at its center a rod-shaped stopper extending vertically and positioning the first ends of the flat pipes 63. The stopper of the partitioning member 112 has open opposite ends through which the refrigerant flows from the porous pipe-side member 111 toward the pipe-side member 113. The pipe-side member 113 has an arc shape cross-section cut along a plane perpendicular to the vertical direction. The pipe-side member 113 has a plurality of openings 115 into which connection pipes 161 arranged vertically are respectively inserted.

The gas collecting pipe 160 is a one end-closed cylindrical straight pipe. The gas collecting pipe 160 has in its side surface a plurality of openings to which the connection pipes 161 are respectively connected. The gas collecting pipe 160 and the first header collecting pipe 110 are tied together in a bundle with tying bands 162 made of an aluminum alloy. An inverted "U"-shaped pipe 180 made of an aluminum alloy is connected to an upper side of the gas collecting pipe 160. The inverted "U"-shaped pipe 180 forms a part of the refrigerant pipe 19.

In the heat source-side heat exchanger 10, the flat pipes 63 in the leeward row communicate with the inverted "U"-shaped pipe 180 via the first header collecting pipe 110, the connection pipes 161, and the gas collecting pipe 160.

(4-3) Second Header Collecting Pipe 120

Figure 7:
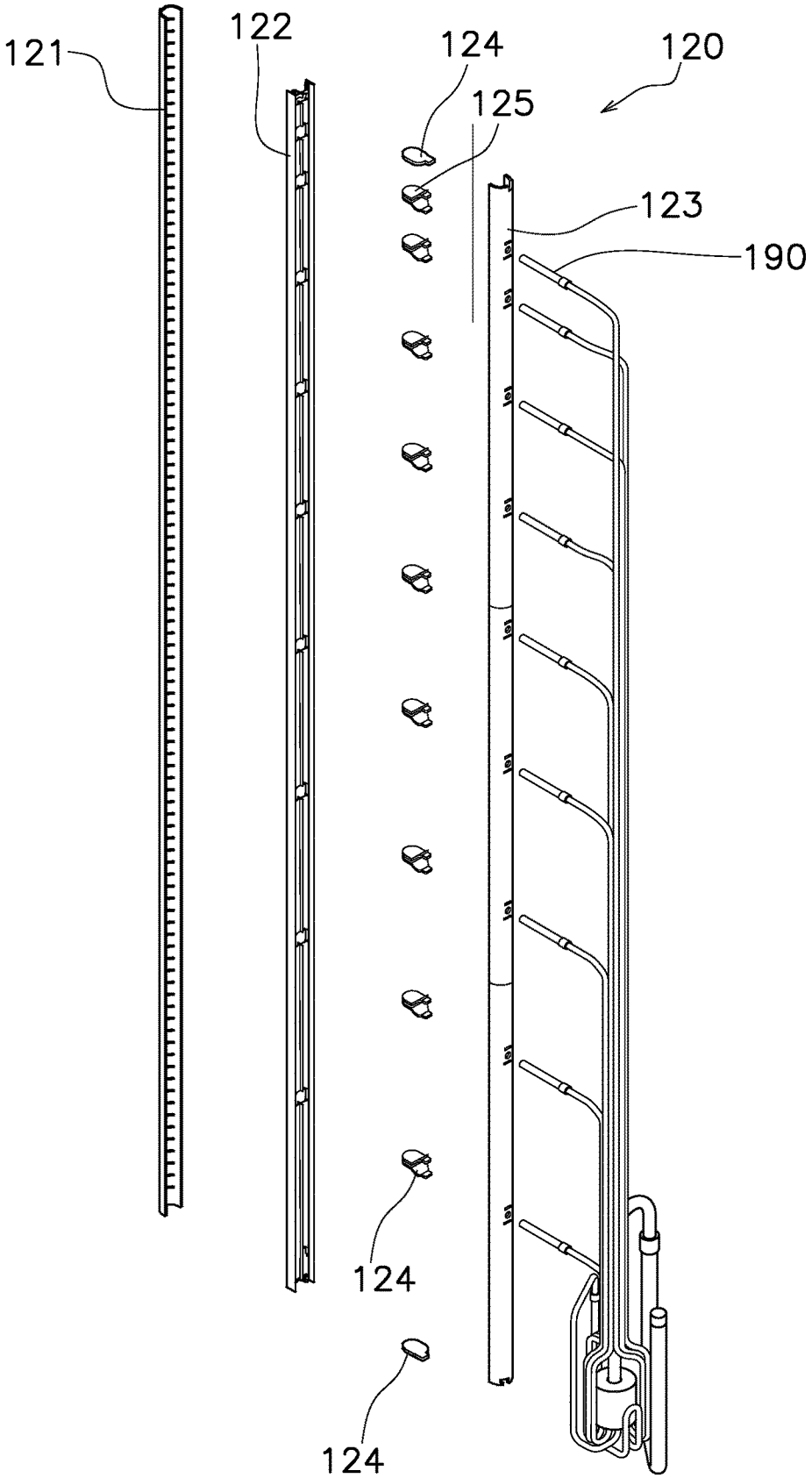
FIG. 7 is an exploded perspective view of a second header collecting pipe.
Figure 8:
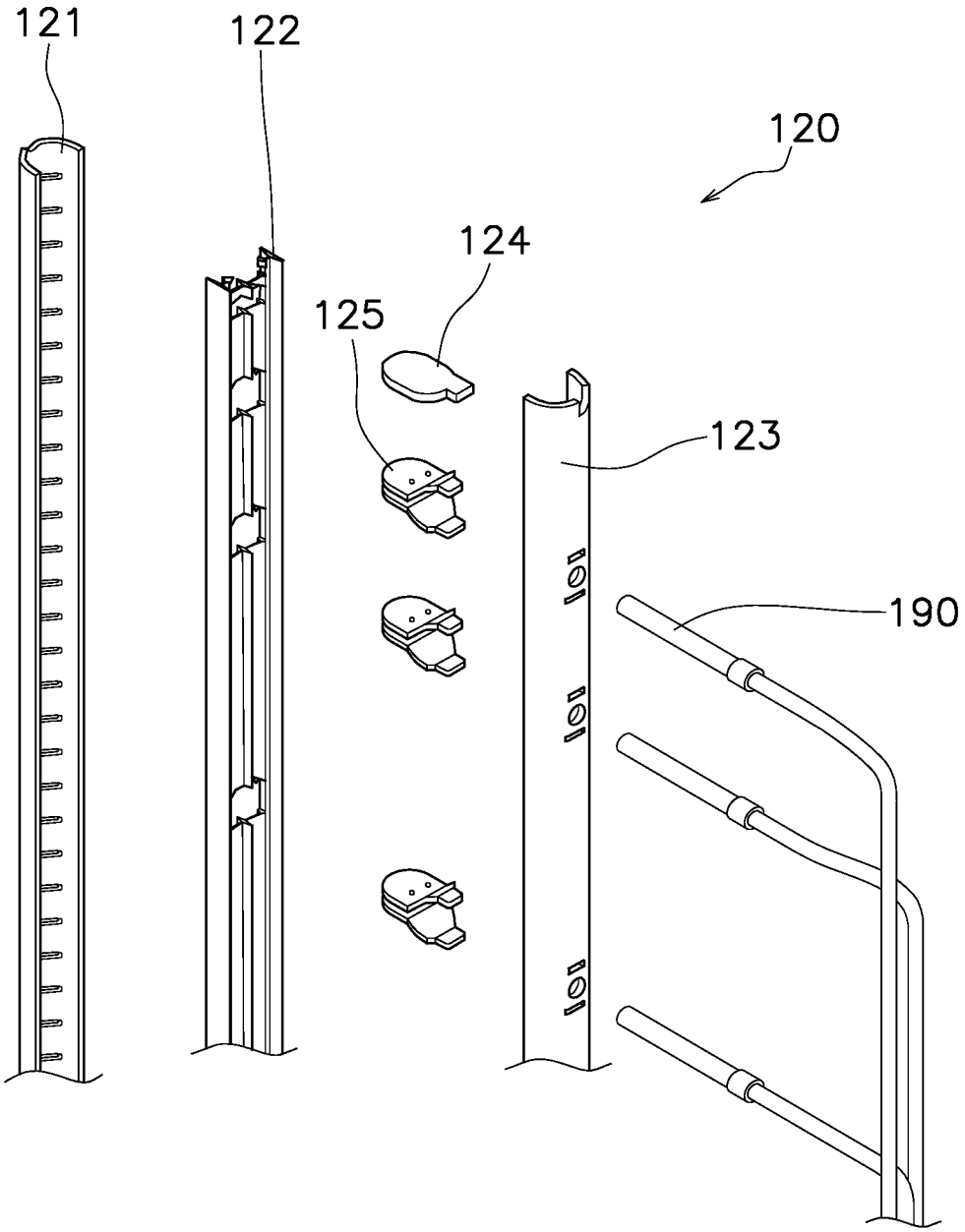
FIG. 8 is an exploded perspective view of the second header collecting pipe with a part of the second header collecting pipe illustrated in an enlarged manner.
Figure 9:
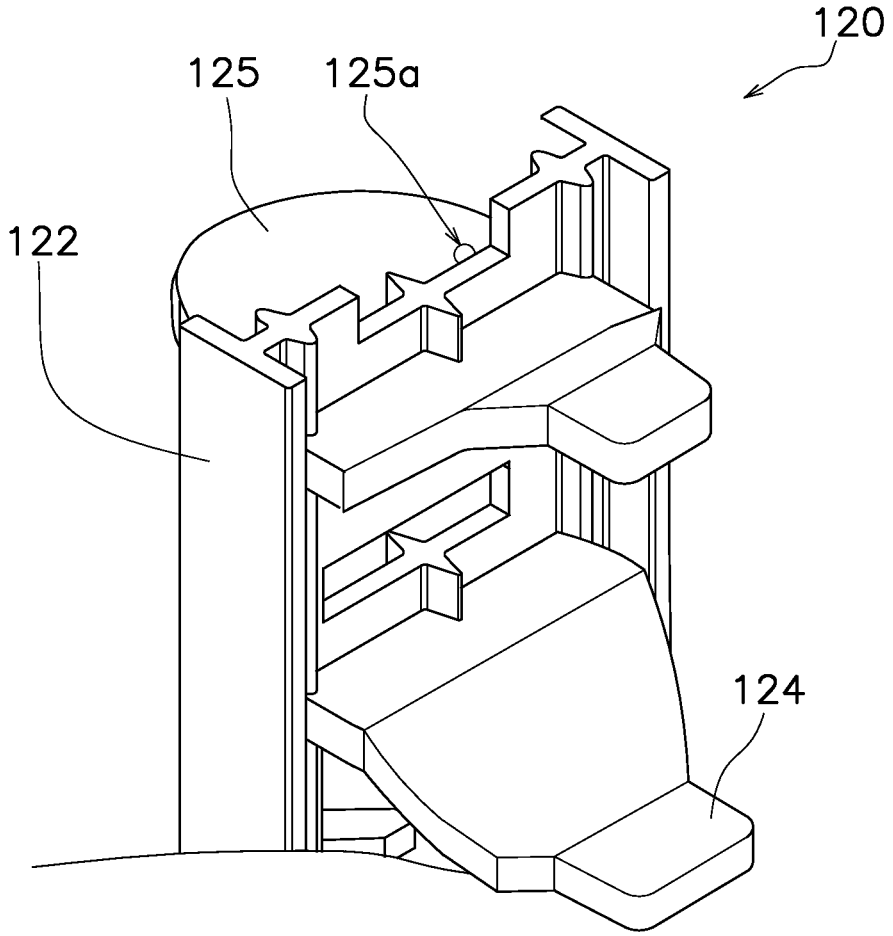
FIG. 9 is an enlarged perspective view of a partitioning member, a rectifier plate, and a partition plate.
Figure 10:
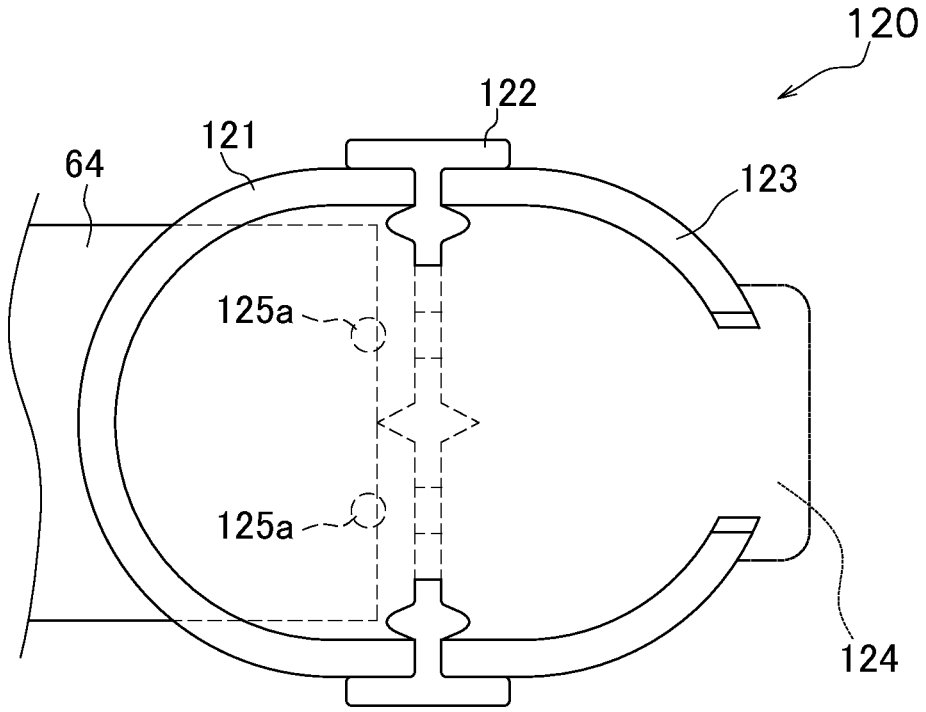
FIG. 10 is a plan view of the second header collecting pipe.
Figure 11:
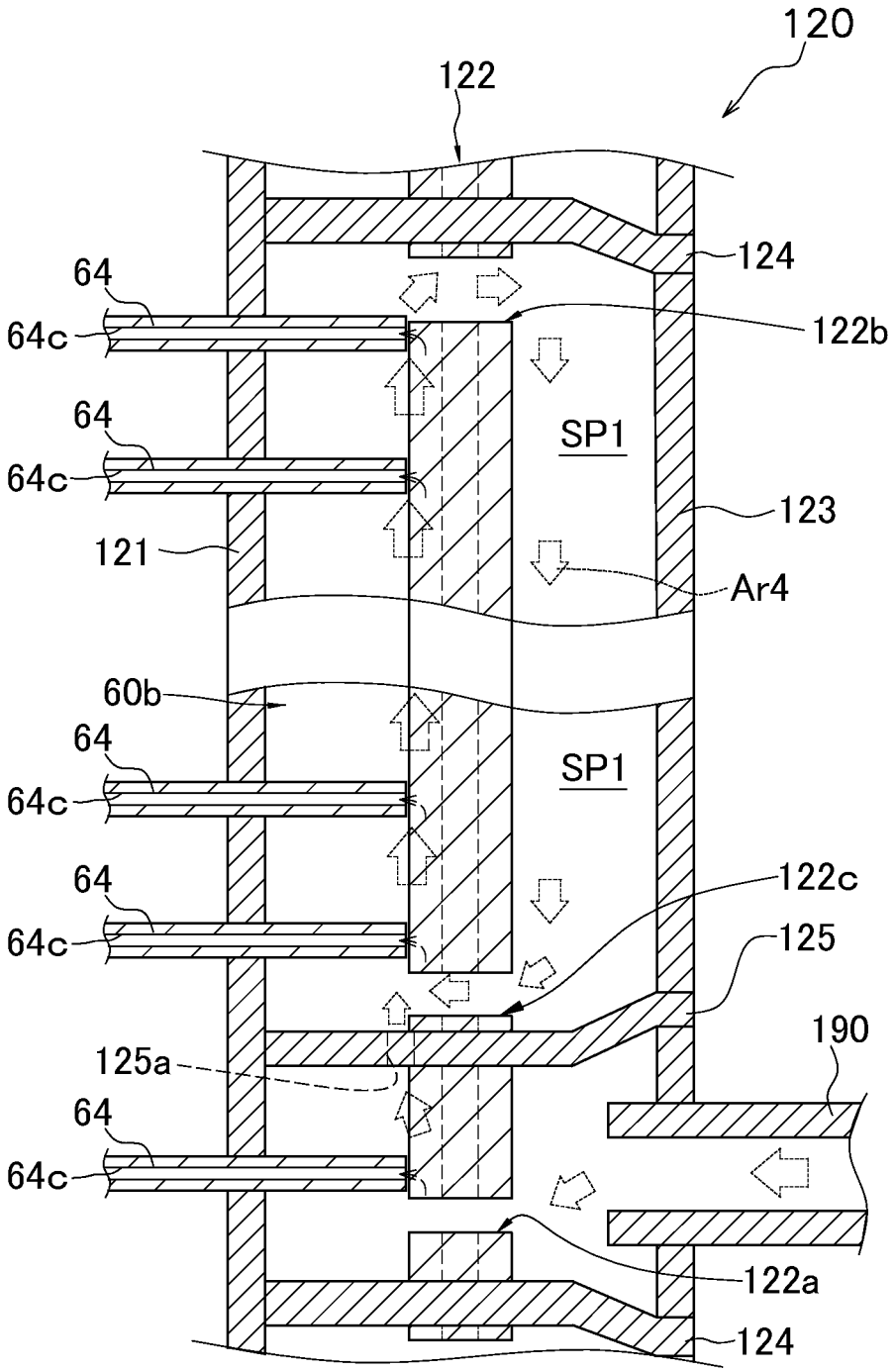
FIG. 11 is a partially enlarged sectional view of the second header collecting pipe.

FIG. 7 is an exploded view of the second header collecting pipe 120. FIG. 8 is a partially enlarged view of the second header collecting pipe 120 illustrated in FIG. 7. FIG. 9 is a partially enlarged view of a partitioning member 122 to which a partition plate 124 and a rectifier plate 125 are mounted. FIG. 10 illustrates the assembled second header collecting pipe 120 seen from above. FIG. 11 is a sectional view of a structure of a part of the second header collecting pipe 120. The second header collecting pipe 120 is an elongated hollow tubular component whose upper and lower ends are closed. The second header collecting pipe 120 is disposed upright on the first end side of the heat exchange part 140 in the windward row. The second header collecting pipe 120 includes a porous pipe-side member 121, the partitioning member 122, a pipe-side member 123, partition plates 124, and rectifier plates 125. The elongated porous pipe-side member 121, partitioning member 122, and pipe-side member 123 are combined with their longitudinal directions oriented vertically, and are integrated with the partitioning member 122 interposed between the porous pipe-side member 121 and the pipe-side member 123. The porous pipe-side member 121, the partitioning member 122, and the pipe-side member 123 thus integrated form the second header collecting pipe 120 extending vertically in the heat source-side heat exchanger 10. Uppermost and lowermost ones of the partition plates 124 respectively close the top and bottom of the second header collecting pipe 120. The porous pipe-side member 121, the partitioning member 122, the pipe-side member 123, the partition plates 124, and the rectifier plates 125 are integrated with one another by, for example, joining in a furnace with a brazing material.

In the second header collecting pipe 120, the partition plates 124 divide the inside of the second header collecting pipe 120 into a plurality of spaces. As illustrated in FIG. 11, the flat pipes 64 arranged in the multiple tiers communicate with a space SP1 defined by two of the partition plates 124. In addition, at least one capillary tube 190 also communicates with the space SP1. A rectifier plate 125 is located near an upper portion of the capillary tube 190. The partitioning member 122 has an opening 122*a* located near an upper portion of a lower one of the partition plates 124, an opening 122*b* located near a lower portion of an upper one of the partition plates 124, and an opening 122*c* located near an upper portion of the rectifier plate 125. The rectifier plate 125 has an opening 125*a* for upward flow. When the refrigerant from the capillary tube 190 reaches a space between the partitioning member 122 and the porous pipe-side member 121 through the opening 122*a*, the refrigerant is blown upward through the small opening 125*a* for upward flow. Thereafter, the refrigerant flows through the opening 122*c* subsequent to the opening 122*b* in the form of a loop as indicated by wide arrows Ar4 in FIG. 11. The refrigerant diverted from the loop-shaped flow flows into the flat pipes 64 arranged in the multiple tiers and located between the rectifier plate 125 and the upper partition plate 124.

(4-4) Coupling Header 200

Figure 12:
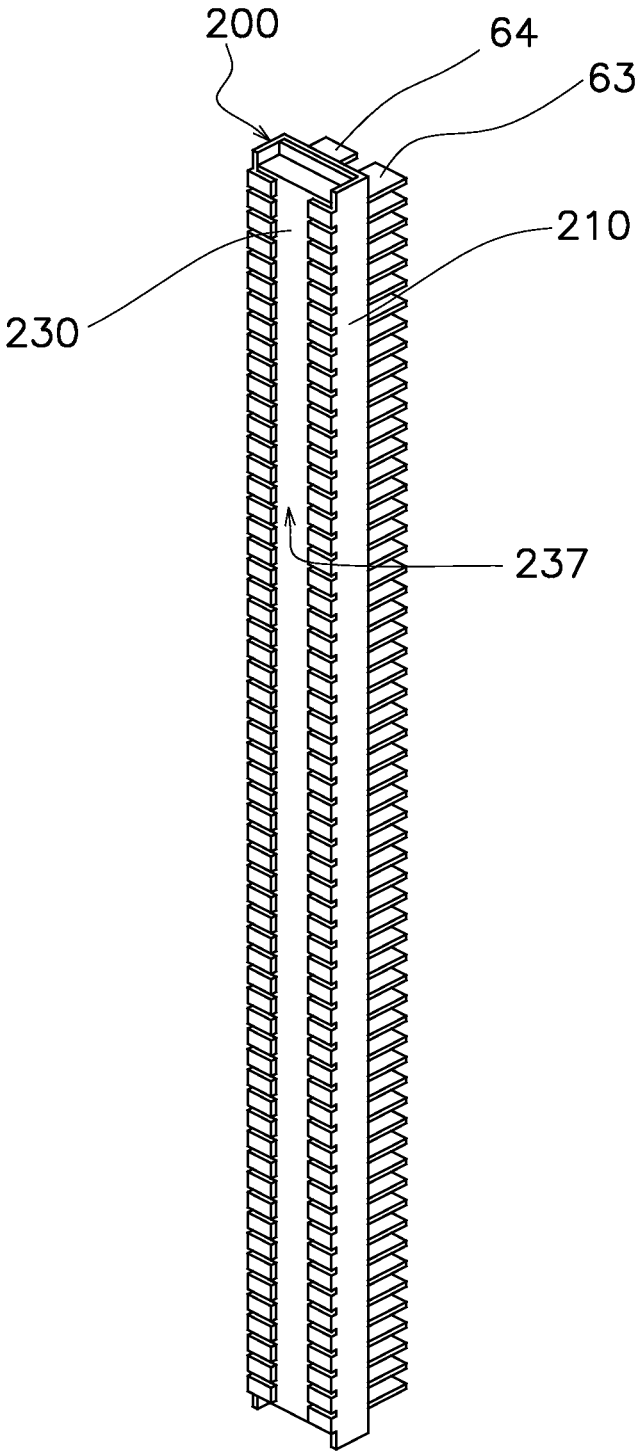
FIG. 12 is a perspective view of a coupling header.
Figure 13:
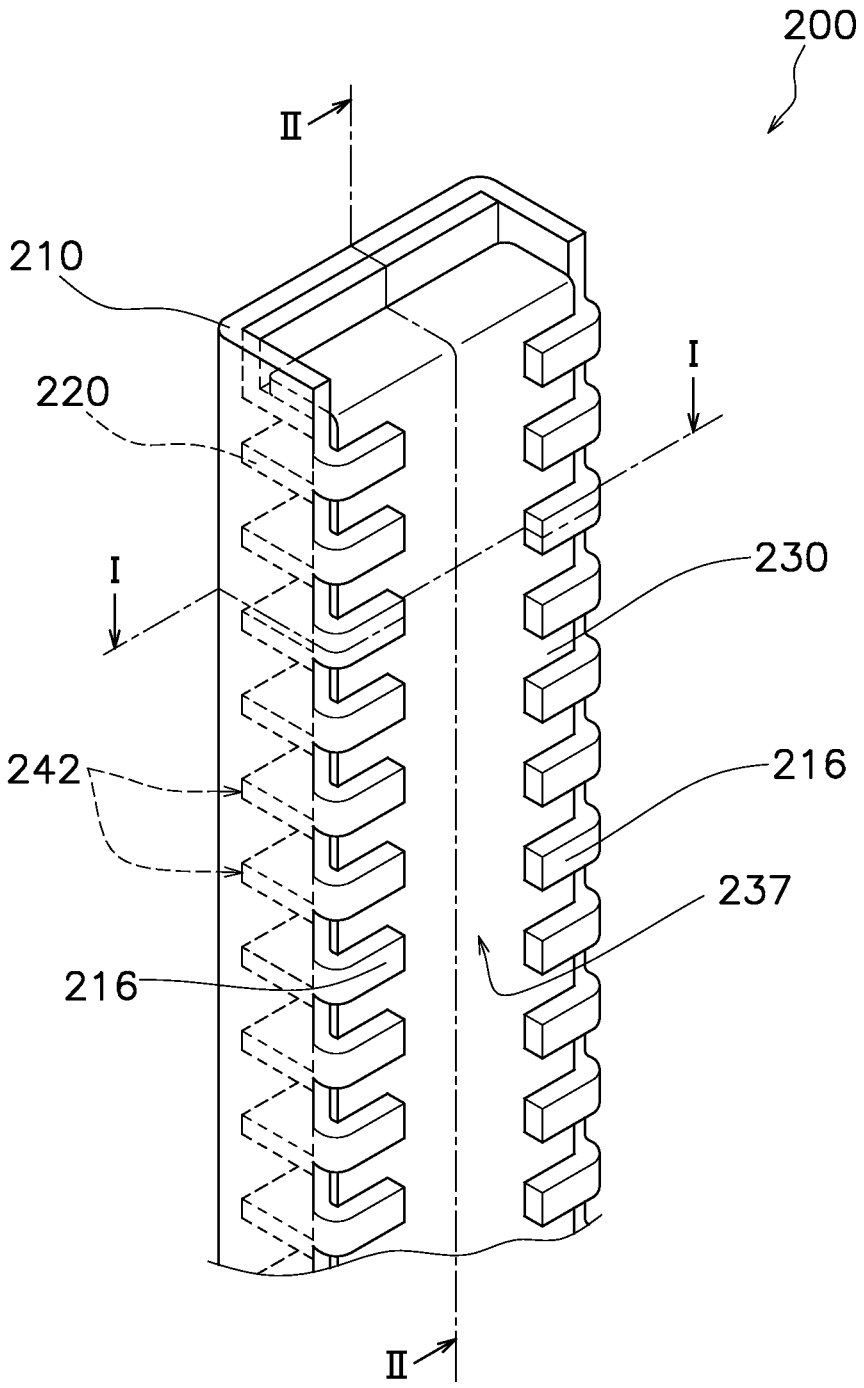
FIG. 13 is an enlarged perspective view of an upper portion of the coupling header.
Figure 14:
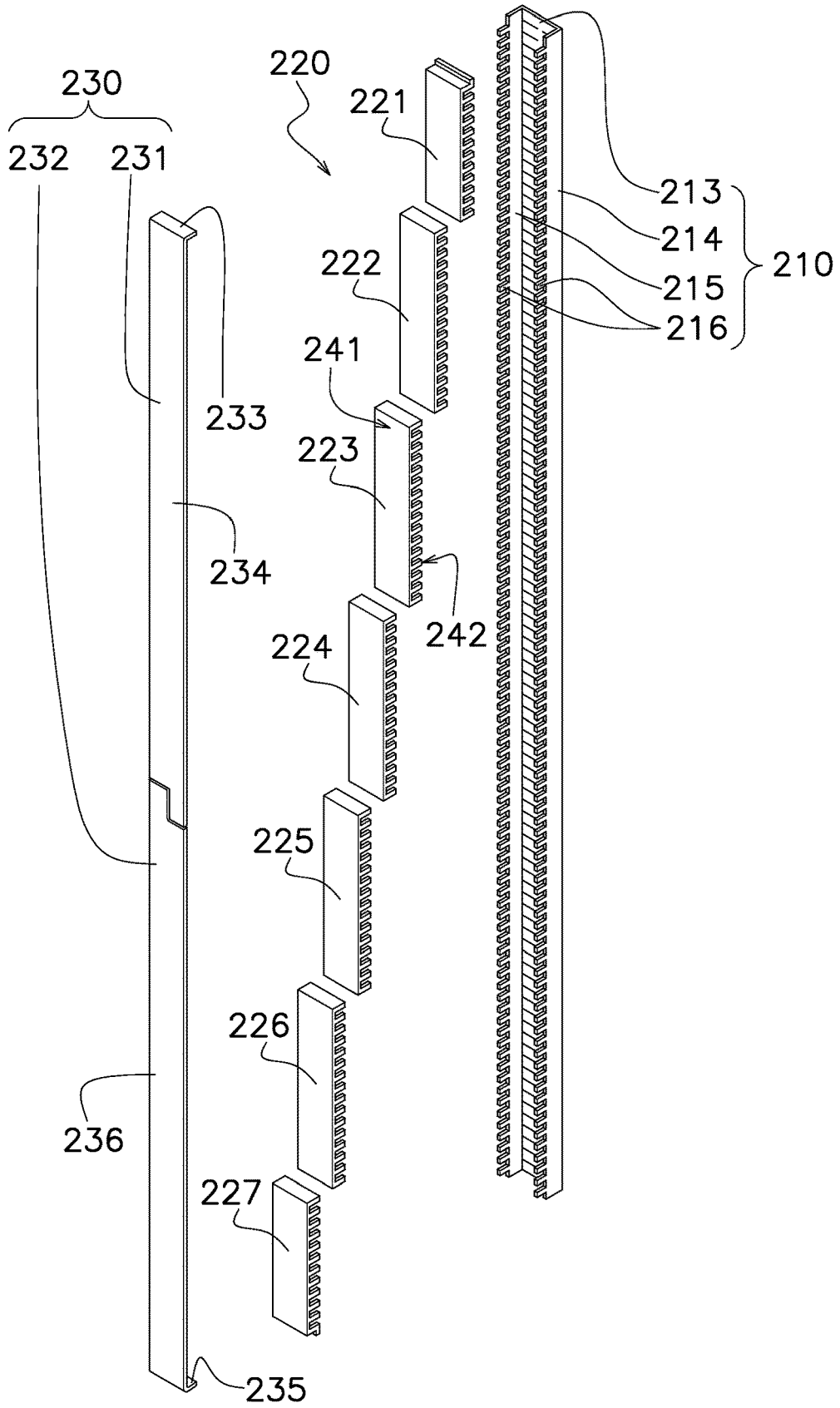
FIG. 14 is an exploded perspective view of the coupling header.
Figure 15:
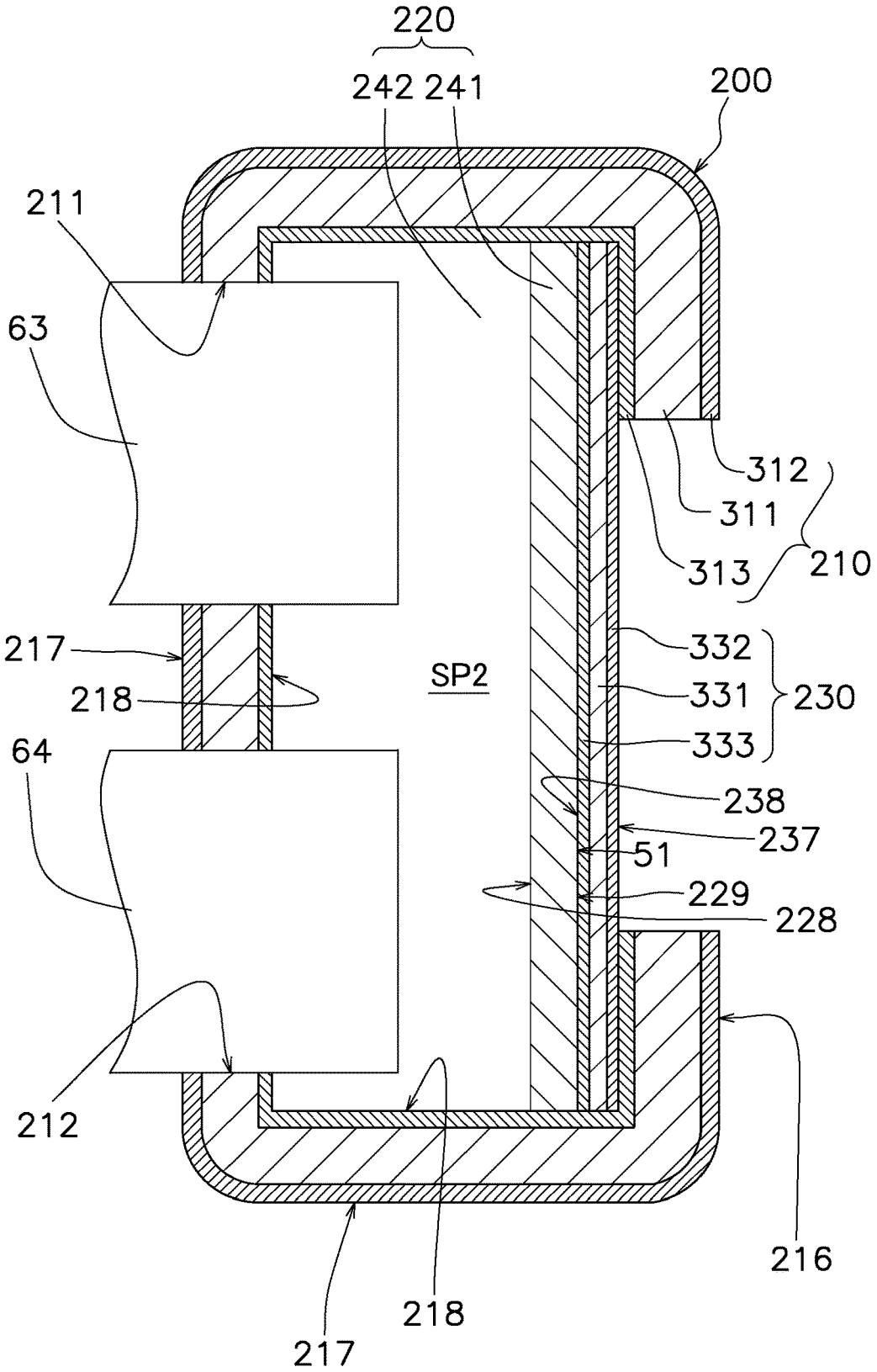
FIG. 15 is a sectional view taken along line I-I in FIG. 13, which schematically illustrates a sectional structure of the coupling header.
Figure 16:
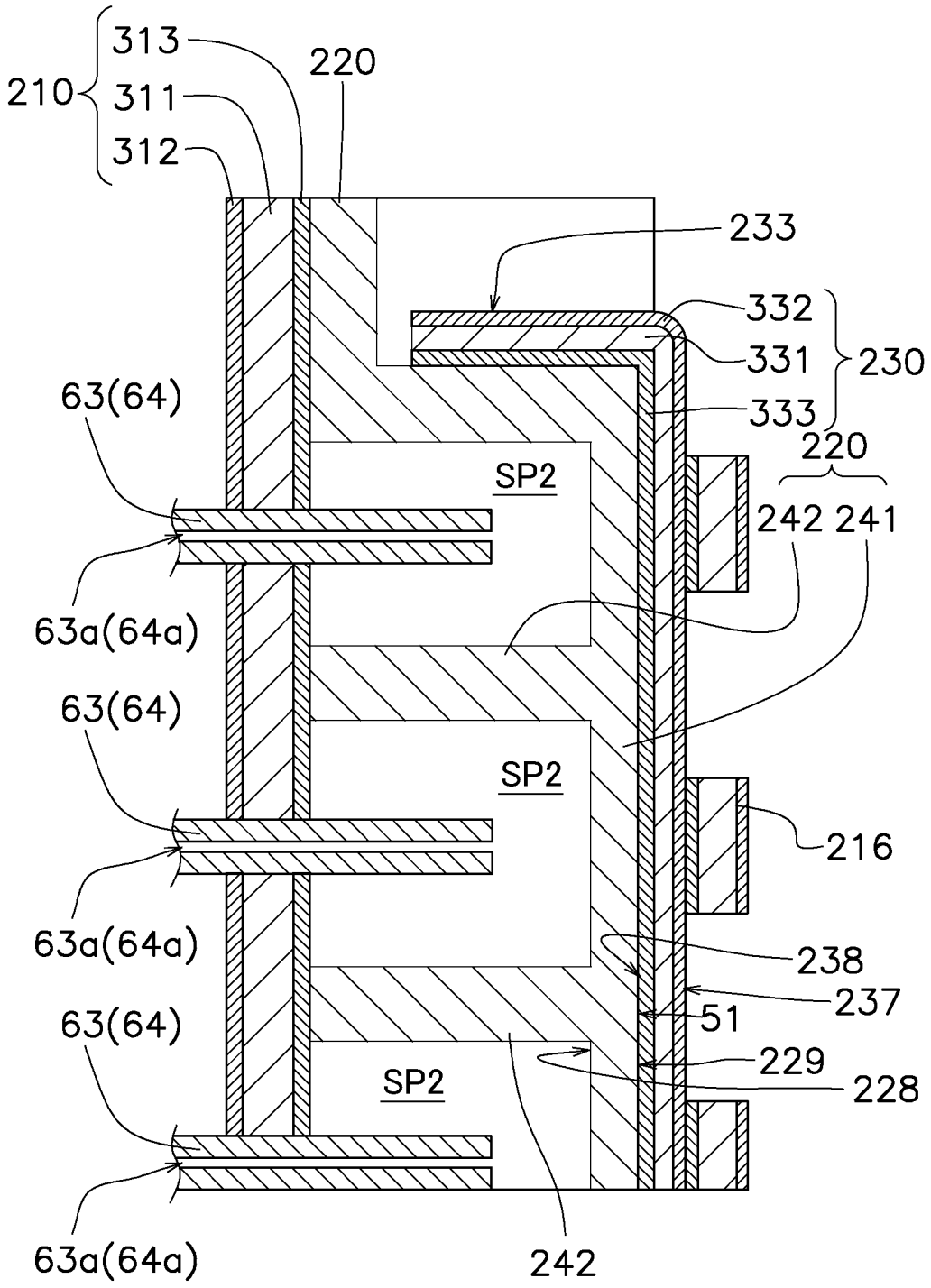
FIG. 16 is a sectional view taken along line II-II in FIG. 13, which schematically illustrates a sectional structure of the coupling header.

FIG. 12 illustrates the coupling header 200 seen obliquely from above. FIG. 13 is an enlarged view of an upper portion of the coupling header 200. FIG. 14 is an exploded view of the coupling header 200. FIG. 15 is a sectional view taken along line I-I in FIG. 13. FIG. 16 is a sectional view taken along line II-II in FIG. 13. The coupling header 200 is an elongated hollow tubular component whose upper and lower ends are closed. The coupling header 200 is disposed upright on the second end side of the heat exchange part 130 in the leeward row and the second end side of the heat exchange part 140 in the windward row.

The coupling header 200 includes a first member 210, a second member 220, and a third member 230 that are joined together. As illustrated in FIG. 14, in a state before being assembled into the coupling header 200, the first member 210 includes a porous pipe sidewall 213 elongated vertically, and two sidewalls 214 and 215 respectively extending from the longer sides of the porous pipe sidewall 213 in a direction intersecting the porous pipe sidewall 213. Each of the sidewalls 214 and 215 has a plurality of claws 216 on one of its two longer sides, the one being opposite from the porous pipe sidewall 213. As illustrated in FIGS. 12 and 13, after the assembly, the claws 216 are bent to come into contact with an exposed surface 237 of the third member 230. The porous pipe sidewall 213 has two openings 211 and 212 arranged in a direction perpendicular to the vertical direction. The openings 211 and 212 are formed in correspondence with the second ends of the flat pipes 63 arranged in the multiple tiers in the leeward row and the second ends of the flat pipes 64 arranged in the multiple tiers in the windward row.

The second member 220 is split into a plurality of split bodies 221 to 227. In the second member 220, each of the split bodies 221 to 227 has a flat plate-shaped seal wall 241 extending vertically, and a partition wall 242 extending in a direction intersecting the seal wall 241. The seal walls 241 face the porous pipe sidewall 213. The openings 211 and 212 are located between adjacent two of the partition walls 242 in the vertical direction. In other words, the passages 63*c* of one of the flat pipes 63 in the leeward row and the passages 64*c* of one of the flat pipes 64 in the windward row communicate with a communication space SP2 defined by adjacent two of the partition walls 242 in the vertical direction, the porous pipe sidewall 213, the sidewalls 214 and 215, and the seal walls 241. During the cooling operation, accordingly, the refrigerant flows into the communication space SP2 through the passages 63*c* of one of the flat pipes 63 in the leeward row, turns back at the communication space SP2, and then flows into the passages 64*c* of a neighboring one of the flat pipes 64 in the windward row. During the heating operation, in the reverse order of that during the cooling operation, the refrigerant flows into the communication space SP2 through the passages 64*c* of one of the flat pipes 64 in the windward row, turns back at the communication space SP2, and then flows into the passages 63*c* of a neighboring one of the flat pipes 63 in the leeward row.

The third member 230 is split into an upper member 231 and a lower member 232. The upper member 231 includes an upper end portion 233 and an upper flat portion 234. For example, the upper end portion 233 and the flat plate-shaped upper flat portion 234 elongated downward from the upper end portion 233 can be formed by bending an end of a flat plate-shaped member. The lower member 232 includes a lower end portion 235 and a lower flat portion 236. For example, the lower end portion 235 and the flat plate-shaped lower flat portion 236 elongated downward from the lower end portion 235 can be formed by bending an end of a flat plate-shaped member. The upper flat portion 234 and the lower flat portion 236 form a rectangular shape. In forming the rectangular shape, a joint between the upper flat portion 234 and the lower flat portion 236 is not linear, but a convex portion on one of the upper flat portion 234 and the lower flat portion 236 is fitted into a concave portion in the other one of the upper flat portion 234 and the lower flat portion 236. The vertical length of the upper flat portion 234 and lower flat portion 236 corresponds to the vertical length of the seven seal walls 241 of the split bodies 221 to 227 arranged vertically. That is, the upper flat portion 234 and the lower flat portion 236 are joined to the seven seal walls 241. The upper end portion 233 is joined to an upper surface of the split body 221, and the lower end portion 235 is joined to a lower surface of the split body 227.

(4-5) Sectional Structure of Members of Coupling Header 200

As illustrated in FIG. 15, the first member 210 includes a first core 311, a first sacrificial anode layer 312, and a first cladding layer 313. Each of the first core 311, the first sacrificial anode layer 312, and the first cladding layer 313 is made of an aluminum alloy. The aluminum alloy for the first core 311 may be, for example, an aluminum alloy to which manganese (Mn) is added (i.e., an Al—Mn based aluminum alloy). Examples of the Al—Mn based aluminum alloy may include 3000-series aluminum alloys specified in Japanese Industrial Standards (e.g., JIS H4000).

The aluminum alloy for the first cladding layer 313 serving as a brazing material may be, for example, an aluminum alloy to which silicon (Si), magnesium (Mg), and nickel (Ni) are added (i.e., an Al—Si—Mg—Ni based aluminum alloy).

A material for the first sacrificial anode layer 312 is a metal that is electrochemically baser than a material for the first core 311. The first sacrificial anode layer 312 also serves as a brazing material for the first core 311. The aluminum alloy for the first sacrificial anode layer 312 may be, for example, an aluminum alloy obtained by further adding 0.5-3.0% Zn to an Al—Si—Mg—Ni based aluminum alloy. For example, an aluminum alloy for the first sacrificial anode layer 312 may be obtained by adding 0.5-3.0% Zn to an aluminum alloy for the first cladding layer 313. As to a comparison between an Al—Mn based aluminum alloy as a material for the first core 311 and an aluminum alloy obtained by further adding Zn to an Al—Si—Mg—Ni based aluminum alloy as a material for the first sacrificial anode layer 312, the aluminum alloy obtained by adding Zn to the Al—Si—Mg—Ni based aluminum alloy is set to be baser than the Al—Mn based aluminum alloy.

The first member 210 is obtained by processing a plate member that is made of an aluminum alloy and has a first main surface on which the first sacrificial anode layer 312 is formed and a second main surface on which the first cladding layer 313 is formed. Such a plate member on which the first sacrificial anode layer 312 and the first cladding layer 313 are formed can be inexpensively produced by, for example, roll bonding. The roll bonding can be made by, for example, hot extrusion processing. The openings 211 and 212 are formed in the plate member of the aluminum alloy. In addition, the claws 216 are formed on the plate member, and then are bent. The first member 210 is thus obtained.

The second member 220 is made of an aluminum alloy. An aluminum alloy for the second member 220 may be an Al—Mn based aluminum alloy. The second member 220 may be equal in material to the first core 311 in order that one of the second member 220 and the first core 311 is not corroded earlier than the other. The second member 220 is formed integrally by, for example, extrusion molding. For this purpose, according to one or more embodiments, the second member 220 is made of a single aluminum alloy. The second member 220 used herein is an extruded molding.

As illustrated in FIG. 15, the third member 230 includes a second core 331, a second sacrificial anode layer 332, and a second cladding layer 333. Each of the second core 331, the second sacrificial anode layer 332, and the second cladding layer 333 is made of an aluminum alloy. An aluminum alloy for the second core 331 may be, for example, an Al—Mn based aluminum alloy. The second core 331 may be equal in material to the first core 311 in order that one of the first core 311 and the second core 331 is not corroded earlier than the other.

An aluminum alloy for the second cladding layer 333 serving as a brazing material may be, for example, an Al—Si—Mg—Ni based aluminum alloy. The second cladding layer 333 may be equal in material to the first cladding layer 313 since the second cladding layer 333 and the first cladding layer 313 are simultaneously used for brazing in a furnace.

A material for the second sacrificial anode layer 332 is a metal that is electrochemically baser than a material for the second core 331. The second sacrificial anode layer 332 also serves as a brazing material for the second core 331. The aluminum alloy for the second sacrificial anode layer 332 may be, for example, an aluminum alloy obtained by further adding 0.5-3.0% Zn to an Al—Si—Mg—Ni based aluminum alloy. For example, an aluminum alloy for the second sacrificial anode layer 332 may be obtained by adding 0.5-3.0% Zn to an aluminum alloy for the second cladding layer 333. As to a comparison between an Al—Mn based aluminum alloy as a material for the second core 331 and an aluminum alloy obtained by further adding Zn to an Al—Si—Mg—Ni based aluminum alloy as a material for the second sacrificial anode layer 332, the aluminum alloy obtained by adding Zn to the Al—Si—Mg—Ni based aluminum alloy is set to be baser than the Al—Mn based aluminum alloy.

The third member 230 is obtained by processing a plate member that is made of an aluminum alloy and has a first main surface on which the second sacrificial anode layer 332 is formed and a second main surface on which the second cladding layer 333 is formed. Such a plate member on which the second sacrificial anode layer 332 and the second cladding layer 333 are formed can be inexpensively produced by, for example, roll bonding. The roll bonding can be made by, for example, hot extrusion processing. The plate member of the aluminum alloy is cut at a portion corresponding to the joint between the upper flat portion 234 and the lower flat portion 236. In addition, the plate member is bent at portions corresponding to the upper end portion 233 and lower end portion 235. The third member 230 is thus obtained.

As illustrated in FIGS. 15 and 16, the first member 210 has a first inner surface 218 where the heating medium flows, and a first outer surface 217 that is on the opposite side of the first inner surface 218. In other words, the first member 210 has the first outer surface 217 directed outward of the coupling header 200, and the first inner surface 218 directed inward of the coupling header 200. The first ends of the flat pipes 63 and 64 passing through the first core 311 of the first member 210 are disposed on the first inner surface 218. The second member 220 has a second inner surface 228 where the heating medium flows, and a second outer surface 229 that is on the opposite side of the second inner surface 228. In other words, the second member 220 has the second inner surface 228 directed inward of the coupling header 200. The first inner surface 218 and the second inner surface 228 define a plurality of the communication spaces SP2 through which the first ends of the flat pipes 63 and 64 communicate with each other. In other words, the first inner surface 218 and the second inner surface 228 face the communication spaces SP2. The third member 230 has a joining surface 238 facing a partial region of the second outer surface 229, and an exposed surface 237 that is on the opposite side of the joining surface 238. In other words, the third member 230 has the exposed surface 237 directed outward of the coupling header 200.

In the third member 230, the joining surface 238 on the opposite side of the exposed surface 237 is joined to the second outer surface 229. The portion where the joining surface 238 of the third member 230 and the second outer surface 229 of the second member 220 are joined together corresponds to a brazed joint. The brazed joint between the joining surface 238 of the third member 230 and the second outer surface 229 of the second member 220 includes the second cladding layer 333 serving as a brazing material for brazing in a furnace.

In the first inner surface 218 of the first member 210, portions that are in contact with the second member 220 and the third member 230 are respectively brazed to the second member 220 and the third member 230 with the first cladding layer 313. In the second member 220, for example, distal end surfaces and side surfaces of the partition walls 242 are brazed to the first inner surface 218 of the first member 210 with the first cladding layer 313.

Figure 17:
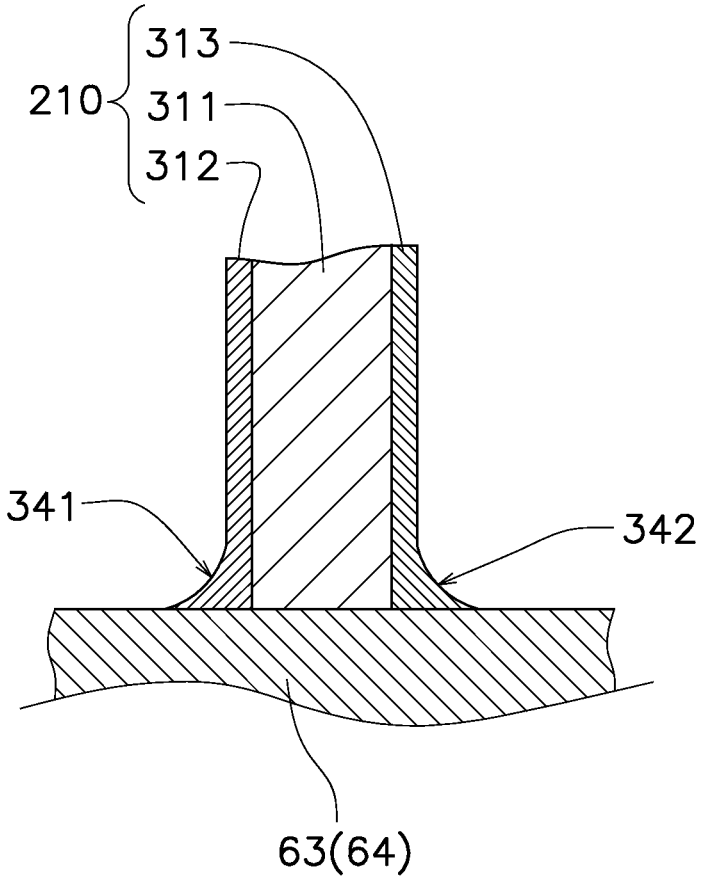
FIG. 17 is a partially enlarged sectional view of a portion where a flat pipe and a first member are joined together.

In addition, side surfaces of the seal walls 241 are brazed to the first inner surface 218 with the first cladding layer 313. The first sacrificial anode layer 312 on the first outer surface 217 of the first member 210 serves as a brazing material to form fillets 341 on the flat pipes 63 and 64 as illustrated in FIG. 17. Likewise, the first cladding layer 313 also forms fillets 342 on the flat pipes 63 and 64.

In the first member 210, the first outer surface 217 is entirely covered with the first sacrificial anode layer 312. The ends of the claws 216 are partially uncovered with the first sacrificial anode layer 312. These uncovered portions are located near the first sacrificial anode layer 312, and are therefore prevented by the first sacrificial anode layer 312 from being corroded. In the second member 220, distal ends of the upper end portion 233 and lower end portion 235 are bent into an "L" shape to enlarge a joint area to the first member 210. According to this structure, the distal ends of the upper end portion 233 and lower end portion 235 are not covered with the second sacrificial anode layer 332, but are located near the second sacrificial anode layer 332 suppressing corrosion of the upper end portion 233 and lower end portion 235. In addition, the length from the distal ends of the upper end portion 233 and lower end portion 235 to the communication spaces SP2 is greater than thickness of the upper end portion 233 and lower end portion 235. Therefore, the exposed distal ends of the upper end portion 233 and lower end portion 235 exert almost no influence upon leakage of the refrigerant due to corrosion.

(5) Features 5-1

The second member 220 made of an aluminum alloy has such a complicated shape that the partition walls 242 protrude from each seal wall 241. Forming a sacrificial anode layer on each seal wall 241 having the complicated shape raises the cost for producing the second member 220. According to one or more embodiments, since the second member 220 includes no sacrificial anode layer, the second member 220 is inexpensively produced by, for example, extrusion molding. The third member 230 is jointed to the partial region 51 of the second member 220 except the second inner surface 228 of the second member 220. According to one or more embodiments, the partial region 51 corresponds to the joining surface 238 that is on the opposite side of the exposed surface 237 of the third member 230. That is, in the second member 220, the partial region 51 which is uncovered with the first member 210 and therefore is unsatisfactory in terms of corrosion protection is covered with the second sacrificial anode layer 332 of the third member 230, so that the third member 230 improves the corrosion resistance of the second member 220. This configuration thus inexpensively improves the corrosion resistance of the coupling header 200 in the heat source-side heat exchanger 10 and, in turn, inexpensively improves the corrosion resistance of the entire heat source-side heat exchanger 10.

5-2

According to one or more embodiments, the second cladding layer 333 as the brazed joint ensures favorable joining on the entire surface of the brazed joint between the second outer surface 229 of the second member 220 and the joining surface 238 of the third member 230. This configuration therefore suppresses an increase in corrosion protection area caused by an increase in surface areas of the second member 220 and third member 230 due to a gap between unjoined portions. This configuration thus efficiently achieves the effect of corrosion protection by the second sacrificial anode layer 332.

5-3

According to one or more embodiments, the brazed joint between the joining surface 238 of the third member 230 and the second outer surface 229 of the second member 220 includes the second cladding layer 333 serving as a brazing material for brazing in a furnace. As described above, the brazed joint between the second member 220 and the third member 230 includes a brazing material for brazing in a furnace. This configuration suppresses flux, and also suppresses a reduction in corrosion resistance around a brazed portion. Likewise, the first cladding layer 313 also includes a brazing material for brazing in a furnace. This configuration therefore suppresses flux even at a joint portion to be joined by the first cladding layer 313, and also suppresses a reduction in corrosion resistance around a brazed portion.

5-4

According to one or more embodiments, the second member 220 is an extruded molding. This configuration therefore inexpensively achieves a complicated shape of the second member 220 surrounding the communication spaces SP2. Extrusion molding as a method of forming the partition walls 242 of the second member 220 is more inexpensive than, for example, cutting or welding as another method of forming the partition walls 242.

5-5

According to one or more embodiments, the second member 220 is split into the split bodies 221 to 227. As compared with the second member 220 that is formed integrally without being split, the second member 220 having the second inner surface 228 for surrounding the communication spaces SP is formed with ease. This results in cost reduction of the coupling header 200 and, in turn, cost reduction of the heat source-side heat exchanger 10.

5-6

According to one or more embodiments, the third member 230 is a plate-shaped member on which the second sacrificial anode layer 332 is formed with ease. That is, the third member 230 including the second sacrificial anode layer 332 is inexpensively produced. This results in cost reduction of the coupling header 200 and, in turn, cost reduction of the heat source-side heat exchanger 10. In addition, the upper end portion 233 and lower end portion 235 as the ends of the third member 230 are bent along the second member 220. Therefore, the upper end portion 233 and the lower end portion 235 are hooked on the second member 220. The third member 230 is thus assembled with ease.

5-7

According to one or more embodiments, the first sacrificial anode layer 312 also serves as a brazing material. This configuration therefore facilitates joining of the flat pipes 63 and 64 as a plurality of heat transfer tubes to the first member 210. This results in cost reduction of the coupling header 200 and, in turn, cost reduction of the heat source-side heat exchanger 10.

(6) Modifications (6-1) Modification 1A

In one or more embodiments, each of the first core 311, the second core 331, and the second member 220 is made of an aluminum alloy. Alternatively, each of the first core 311, the second core 331, and the second member 220 may be made of aluminum. Each of the first sacrificial anode layer 312 and the second sacrificial anode layer 332 for the first core 311, the second core 331, and the second member 220 each made of aluminum is made of a metal that is baser than aluminum. Examples of the metal may include 1000-series aluminum alloys specified in JIS H4000. In such a main body made of aluminum, layers each made of an Al—Zn—Mg based aluminum alloy are usable as the first sacrificial anode layer 312 and the second sacrificial anode layer 332. Likewise, each of the heat exchange parts 130 and 140, the first header collecting pipe 110, the second header collecting pipe 120, the tying bands 162, and the inverted "U"-shaped pipe 180 may be made of an aluminum.

(6-2) Modification 1B

In one or more embodiments, the first sacrificial anode layer 312 is equal in material to the second sacrificial anode layer 332. Alternatively, the first sacrificial anode layer 312 may be different in material from the second sacrificial anode layer 332. For example, in a case where each of the first sacrificial anode layer 312 and the second sacrificial anode layer 332 is made of an aluminum alloy, the materials for the first sacrificial anode layer 312 and the second sacrificial anode layer 332 may be made different from each other by changing at least one of a kind of a metal added to an aluminum alloy or a mixing ratio of a metal in an aluminum alloy. The first sacrificial anode layer 312 may be made of a metal electrochemically baser than that for the first core 311. The second sacrificial anode layer 332 may be made of a metal electrochemically baser than that for the second core 331.

(6-3) Modification 1C

In one or more embodiments, the first core 311, the second core 331, and the second member 220 are equal in material to one another. Alternatively, the first core 311, the second core 331, and the second member 220 may be different in material from one another. For example, in a case where each of the first core 311, the second core 331, and the second member 220 is made of an aluminum alloy, the first core 311, the second core 331, and the second member 220 may be different in material from one another by changing at least one of a kind of a metal added to an aluminum alloy or a mixing ratio of a metal in an aluminum alloy.

(6-4) Modification 1D

In one or more embodiments, the third member 230 covers the partial region 51 of the second outer surface 229 in the second member 220 with the joining surface 238 on the opposite side of the exposed surface 237 joined to the partial region 51. Alternatively, the third member 230 may be configured to cover the entire region of the second outer surface 229.

(6-5) Modification 1E

In one or more embodiments, the flat pipes 63 and 64 as a plurality of heat transfer tubes are arranged in the two rows. However, the number of rows is not limited to two. The flat pipes 63 and 64 may be arranged in three or more rows. Still alternatively, the flat pipes may be arranged in a single row. In this case, the refrigerant turns back between flat pipes in different tiers. In a case where the refrigerant turns back between flat pipes in different tiers, partition walls are provided above and below the flat pipes in multiple tiers to define communication spaces such that the flat pipes in the multiple tiers communicate with each other.

(6-6) Modification 1F

One or more embodiments exemplify the coupling header 200 of the heat source-side heat exchanger 10. Alternatively, the configuration of one or more embodiments of the present invention may be applied to the coupling headers of the utilization-side heat exchangers 32*a* and 32*b*.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

10: heat source-side heat exchanger
32*a*, 32*b*: utilization-side heat exchanger
63, 64: flat pipe (example of heat transfer tube)
200: coupling header
210: first member
220: second member
221 to 227: split body
230: third member
231: upper member (example of plate-shaped member)
232: lower member (example of plate-shaped member)
233: upper end portion (example of end of third member)
235: lower end portion (example of end of third member)
311: first core
312: first sacrificial anode layer
331: second core
332: second sacrificial anode layer

PATENT LITERATURE

Patent Literature 1: JP 2016-95087 A

The invention claimed is:

1. A heat exchanger comprising:
heat transfer tubes that are made of aluminum or an aluminum alloy and are disposed in multiple tiers in a first direction that intersects a second direction along which a heating medium flows; and
a coupling header that couples the heat transfer tubes together, wherein
the coupling header comprises a first member, a second member, and a third member,
the first member has:
an inner surface on which the heating medium flows and on which ends of the heat transfer tubes are disposed; and
an outer surface on an opposite side of the inner surface,
the first member comprises:
a core made of aluminum or an aluminum alloy; and
a sacrificial anode layer, disposed on the outer surface, for the core; the second member is made of aluminum or an aluminum alloy,
the second member has:
an inner surface directed toward the inside of the coupling header; and an outer surface on an opposite side of the inner surface of the second member, and the second member lacks a sacrificial anode layer,
the third member has:
a joining surface facing the outer surface of the second member; and
an exposed surface on an opposite side of the joining surface,
the third member comprises:
a core made of aluminum or an aluminum alloy; and
a sacrificial anode layer, disposed on the exposed surface, for the core of the third member, and
the third member covers a partial region or an entire region of the outer surface of the second member by joining the joining surface to the partial region or the entire region.

2. The heat exchanger according to claim 1, wherein the third member further comprises a brazed joint in the partial region or the entire region.

3. The heat exchanger according to claim 2, wherein the brazed joint comprises a brazing material that brazes in a furnace.

4. The heat exchanger according to claim 1, wherein the second member is an extruded molding.

5. The heat exchanger according to claim 1, wherein the second member comprises a first body and a second body that are disposed in the first direction.

6. The heat exchanger according to claim 1, wherein the third member includes a plate-shaped member that has an end bent along the second member.

7. The heat exchanger according to claim 1, wherein the sacrificial anode layer of the first member comprises a brazing material that joins the heat transfer tubes to the first member.

8. An air conditioning apparatus comprising:
the heat exchanger according to claim 1, wherein
the air conditioning apparatus performs air conditioning in a predetermined space by heat exchange between air in the predetermined space and the heating medium circulating through the air conditioning apparatus via the heat exchanger.

* * * * *